US005584197A

United States Patent [19]

Okuno

[11] Patent Number: 5,584,197

[45] Date of Patent: Dec. 17, 1996

[54] KNITTING METHOD

[75] Inventor: Masao Okuno, Wakayama, Japan

[73] Assignee: Shima Seiki Manufacturing Ltd., Wakayama, Japan

[21] Appl. No.: 539,834

[22] Filed: Oct. 6, 1995

[30] Foreign Application Priority Data

Oct. 7, 1994 [JP] Japan ..... 6-243766
Apr. 27, 1995 [JP] Japan ..... 7-104395

[51] Int. Cl.[6] ..... D04B 1/22; D04B 1/24

[52] U.S. Cl. ..... 66/64; 66/60 R; 66/172 R

[58] Field of Search ..... 66/172 R, 176, 66/60 R, 64, 69

[56] References Cited

U.S. PATENT DOCUMENTS 3,695,063 10/1972 Betts et al. ..... 66/176
4,548,057 10/1985 Essig ..... 66/172
4,793,034 12/1988 Poloff et al. ..... 66/172 R X
5,257,514 11/1993 Okuno ..... 66/172 R X
5,271,249 12/1993 Mitsumoto et al. ..... 66/172 R X
5,377,507 1/1995 Shima ..... 66/172 R X
5,379,615 1/1995 Shima ..... 66/176
5,456,096 10/1995 Mitsumoto et al. ..... 66/172 R X

FOREIGN PATENT DOCUMENTS

0446583A1 1/1991 European Pat. Off. .
4-209855 7/1992 Japan .
2006288 10/1978 United Kingdom .

*Primary Examiner*—John J. Calvert
*Attorney, Agent, or Firm*—Nikaido, Marmelstein, Murray & Oram LLP

[57] ABSTRACT

A front fabric 20 is transferred to the opposing needle bed to reverse the order of stitches sidewise. Next, the back fabric 21 is transferred to the opposing needle bed without altering the order of stitches. Then the front fabric 20 is transferred with the order of stitches reversed again. As a result, the curls of the front fabric 20 and the back fabric 21 appear on the outer side, and the binding-off is made under this condition. A first collar and a second collar are formed on the circumference of a neck hole of the front body, and then a back collar of which wale directions are continuous to those of the collars is formed on the back body.

16 Claims, 21 Drawing Sheets

KNITTING METHOD

FIELD OF INDUSTRIAL APPLICATION

This invention relates to reducing the work of post-treatment after knitting fabrics on a flat knitting machine wherein one fabric portion is placed in front and the other in rear.

PRIOR ART

In knitting some knitting products such as sweaters and vests, it is practiced that a front body and a back body are knitted separately, then fabrics after knitting are sewn together to make a cylindrical fabric. This method requires a sewing facility and additional steps of process.

With regard to this problem, in order to reduce the work after knitting, various proposals have been made to knit an integral garment wherein parts are connected in advance. For instance, in Provisional Patent Publication No. HEI-5-86560 (U.S. Pat. No. 4,548,057, GB PATENT 2114,170), of two fabrics, the stitches of the final course of one fabric are made to overlap with the stitches of the final course of the other fabric, and a yarn is fed to the overlapping stitches to form chain stitches. Edge stitches are overlapped on these chain stitches to terminate. It is called binding-off to overlap the final courses of two fabrics with each other and make terminal stitches. Now, application of this method to knitting of a cylindrical fabric will be examined. According to the prior art of knitting cylindrical fabrics, a front body is knitted on a front needle bed, and a back body is knitted on the back needle bed. The final courses of the front body and the back body are connected at the shoulders to reduce the sewing work after knitting. If binding-off is made at this stage according to the disclosure of Provisional Patent Publication No. HEI-5-86560, the binding-off of overlapped fabrics is made on the exterior side of the fabrics, namely, on the surfaces of the fabrics that appear after knitting.

For knitting products such as sweaters and vests, it is normally practiced to sew separately-knitted reinforcing fabrics onto the edges of openings such as those of sleeve and in collar. This method requires skill sewing the separately-knitted collar fabric onto the fabric, and this work requires manual operation and takes much time. Such sewing works are done independently of the knitting, and each process requires a dedicated facility, and the number of processes increases. As a result, the production cost of knitting products increases. Hence, a variety of knitting methods have been proposed to reduce the post-knitting work that increases the production cost of products. For instance, according to Provisional Patent Publication No. HEI-4-153346 (U.S. Pat. No. 5,379,615, EUROPEAN PATENT 556,397), both the front needle bed and the rear needle bed are used to knit a pair of fabrics, one in front and the other in rear, openings are made in the fabric and an appropriate number of wales are knitted along each opening, said wales having a knitting structure suited to edge treatment. This eliminates the need of sewing separately-knitted additional fabrics for edge treatment onto the edges of the fabric.

When Provisional Patent Publication No. HEI-5-86560 is applied to the knitting of a cylindrical fabric, the stitches of the front body and the back body are overlapped with each other for binding-off on the exterior side. As a result, the binding-off portion appears on the surface of the fabric and the chain stitches formed in the binding-off portion come to the surface of the fabric. Moreover, the binding-off portion protrudes.

For instance , according to Provisional Patent Publication No. HEI-4-153346, when a vest having a collar hole normally called V-neck is to be knitted, a front body is knitted on the front needle bed and a back body is knitted on the rear needle bed, thus one in front and the other in rear. At the part for the collar hole of the front body, collars of an appropriate number of wales are formed. Moreover, along the edge of the fabric, stitches of an appropriate number of wales are transferred sequentially to widen the opening and, in turn, to form the collar hole. According to this knitting method, however, no collar is formed for the back body whereas a collar is formed for the front body. Hence, to complete the garment, after knitting on the knitting machine, a separately-knitted fabric for collar is sewn onto the final course of the back body. Then both the ends of the fabric for collar are connected to the final courses of the collars of the front body, or the collars of the front body are knitted even after the completion of the knitting of front body and are sewn onto the final course of the back body.

A method is known wherein in succession to the final course of the back body, collar portions are formed in the same direction of wale as those of the back body and the final courses of the collar portions formed on the front body and the final courses of the collar portions formed on the rear body are connected with each other. According to this method, a collar can be formed on both the front body and the back body. According to the method, however, the directions of wales formed on the front body are not continuous to those of wales formed on the back body. The appearance of the collar, therefore, is not satisfactory.

SUMMARY OF THE INVENTION

One objective of the present invention is to provide a knitting method which require no post-treatment such as sewing after knitting a fabric.

Another objective of the present invention is to provide a knitting method wherein chain stitches appear on the surface of the fabric and the binding-off portions do not protrude.

Another objective of the present invention is to provide a knitting method wherein a collar portion having wales in the same directions as those of wales of collar portions formed on the front body are formed on the back body, thus a collar of good appearance can be formed.

Moreover, another objective of the present invention is to form a collar which requires no post-treatment by binding off the final courses of a pair of collar portions, front and back, formed along the collar hole in such a way that the stitches of the outermost wales and the stitches of the innermost wales are overlapped with each other, respectively.

The present invention uses a flat knitting machine having at least one pair of front and rear needle beds extending sidewise and abutting against each other, wherein each of said one pair of needle beds has a large number of needles, said one pair of needle beds form a trick gap between them, at least one of said pair of needle beds can be racked sidewise, and a fabric can be transferred between said needle beds.

According to the invention, the first fabric (20, 30) is held on one of said needle beds, wherein the first fabric has a large number of stitches with its back facing the trick gap and its face being away from the trick gap, the second fabric (21, 31) is held on the other of said needle beds, wherein the second fabric bas a large number of stitches with its back facing the trick gap and its face being away from the trick gap, and said first and second fabrics are bound off.

The present invention is characterized in that said knitting method includes a: a process of transferring one of said first and second fabrics to the needle bed opposite to a needle bed on which the fabric to be transferred is currently held;

b: a process of transferring, after the process a, the other fabric to the needle bed opposite to the needle bed on which the fabric to be transferred is currently held; and c: a process of transferring, after the processes a and b, one of said first and second fabrics to the needle bed opposite to the needle bed on which the fabric to be transferred is currently held, and overlapping stitches of said first and second fabrics on the needles of the needle bed to which the transfer was made.

In the present specification, it is understood that binding-off includes overlapping two fabrics with each other on the same needles and connecting them with each other. For instance, binding-off is made as shown in FIG. 4, which produces chain stitches. The flat knitting machine to be used may be an ordinary one. In the present specification, the right and left and the front and rear are set when the knitting machine is viewed from the front. The two needle beds abut against each other and the space where the needles of the two needle beds operate is the trick gap. The flat knitting machine with two beds is illustrated as an example. Machines with four beds or six beds may be used, and in such a case, the retreat and transfer of fabrics are much more easier. In the present specification, the back is defined as a side facing the trick gap and the face as its opposite side. They do not necessarily correspond to the face and the back of the fabric after finishing.

According to the present invention, the faces/backs of a pair of fabrics are changed over through three times of transfer of the fabrics. If binding-off is made when the face of each fabric appears on the trick gap side, the protruding portion resulting from the binding-off appear on the back side of the fabric. When the bound-off fabric is removed from the flat knitting machine and the fabric is turned over, the protruding portion resulting from the binding-off is concealed in the back of the fabric and becomes inconspicuous. Connection of fabrics is made by binding-off, and that portion requires no sewing after knitting.

The transfer of fabrics will be explained in the following. Suppose only one needle bed of a pair of needle beds holds a fabric, and the back of the fabric is on the trick gap side. Now, when the fabric is transferred to the other needle bed, the face of the fabric will appear on the trick gap side. Thus if one transfer is given to each of two fabrics, the face/back of each fabric can be reversed. For instance, suppose there are two fabrics each having the back on the trick gap side at the time of start. By the first transfer of each fabric, the faces of both fabrics will appear on the trick gap side. After the second transfer, the two fabrics are held on the different needle beds, respectively, and binding-off can not be made. It, therefore, requires at least three times of transfer. By the third transfer, both the two fabrics are overlapped with each other on the same needle bed. Then the binding-off is made. In this way, the face/back of the fabrics relative to the trick gap side are reversed from the initial state, and for example, when both the faces of the two fabrics appear on the trick gap side, binding-off can be made. The condition of transfer is that by the first two transfers each of two fabrics is transferred one time and the final transfer may be given to either one of the fabrics.

As shown in FIG. 8 of the embodiment, many of fabrics to be bound-off are connected at one point. A casual transfer may strain the joint. To avoid straining, as shown in FIG. 3 and FIG. 8 of the embodiment, it is sufficient to reverse sidewise the order of stitches or turn the fabric by 180 degrees on one edge of the fabric as the axis by the first transfer. In this case, the second transfer is given to the other fabric without any rotation or reversal of the sidewise order of stitches. The final transfer is given to the fabric which was moved first. Here again the order of stitches is reversed sidewise. With these processes, the conditions of the joint of two fabrics resulting from transfer are as shown in FIG. 8B and D and are free from any strains.

In other words, for example, a part of the front fabric is transferred from the front bed onto the back bed. A part of the back fabric is transferred onto the front bed, and then, for example, the part of the front fabric already transferred is retransferred onto the front bed, and is overlapped on the back fabric having been transferred. In this manner, the face side/back side conversion of the two fabrics for the binding-off is performed.

The transfer with sidewise reversal can be accomplished by selecting the sequence of rackings of the needle bed(s) and transfers. For instance, let us take the transfer of FIG. 8B as an example. First, the stitch closest to the axis of rotation W or stitch on the edge of the fabric is transferred. Next, the stitch one stitch inner of the fabric or stitch one stitch away from the axis of rotation W is transferred. One stitch is transferred at a time. The more inner is the position of the stitch on the fabric or the greater is the distance of the stitch away from the axis of rotation W, the greater is the racking of the bed before transfer; the stitch is transferred over stitches that have been transferred.

When the racking range of a needle bed is limited, for instance, when the entire right shoulder of the garment can not be transferred at a time, fabrics to be bound-off may be divided into several portions and the transfer may be made portion by portion. For instance, in case of the right shoulder, one end of the shoulder is transferred first, and the rest is transferred by utilizing the re-racking. When the entire right shoulder has been transferred, the binding-off is given.

When a fabric is to be transferred, if the area of the needle bed to which the fabric is to be transferred is occupied by another fabric, the transfer can not be made. In case of a knitting machine with two beds, it is desirable to remove in advance the area of fabric irrelevant to the transfer from the needle bed. In case of a knitting machine with four or more beds, the fabric can be shifted to another needle bed, and there is no need of literally removing the fabric from the needle bed.

The present invention is in a knitting method which uses a flat knitting machine having at least one pair of front and rear needle beds extending sidewise and abutting against each other, wherein each of said one pair of needle beds has a large number of needles, said one pair of needle beds form a trick gap between them, at least one of said pair of needle beds can be racked sidewise, and a fabric can be transferred between said needle beds, and in a method which holds the front body (42) on one of said needle beds and the back body (43) on the other of said needle beds, wherein the front body and the back body are abutted against each other, and connects the front body and the back body at shoulders (52, 53) and knit a collar (51) along the circumference of a neck hole (45), and is also characterized in that said knitting method includes a: a process of dividing the front body above the lower end of the neck hole (45) into a right front body (42*a*) and a left front body (42*b*) and knitting them, and knitting the first collar (48*a*) and the second collar (48*b*) along the circumference portions of said hole of said right and left front bodies, wherein said collars consist of plurality of wales and have a course direction perpendicular to that of the direction of said wales along the circumference; and b: a process of knitting a back collar (49, 49*a*, 49*b*) on the collar knitting area (50) along the circumference of said hole of the back body;

wherein the front body and the back body are knitted from the bottom toward to the top, and the knitted front body and back body are taken out beneath the needle beds, wherein said back collar is in conjunction with said collar knitting area, and said back collar has a wale direction along the circumference of said opening and a course direction perpendicular to said wale direction, and wherein the wale direction of said back collar is continuous to the wale directions of said first and second collars (48*a*, 48*b*).

Embodiments corresponding to this are shown in FIG. 9 through FIG. 23. As a result, as shown in FIG. 9, FIG. 10, etc., a collar of which wale direction is continuous is formed around the neck hole. There is no need of knitting a collar member separately and sewing it onto the body. The wale direction of the collar is continuous as if the wales surround the circumference of the hole, resulting in an excellent appearance. The connections of the shoulders are preferably done by using three transfers as mentioned above to reverse the face/back of the two fabrics.

In this specification, the collar knitting area is a back body's area facing the neck opening, or the stitches of that area. Preferably either one of the right and left collars is transferred to the opposite needle bed with the order of stitches reversed sidewise. With this arrangement, when the knitting of the back collar is completed and the respective parts of the collar are ready for binding off, their conditions are just as shown, for example, in FIG. 23. Under such conditions, for example, if a transfer is made so that the stitches of the final course of the right collar overlap with the back collar, the binding-off can be made.

More preferably, both the right and left collars are transferred to the opposite needle beds, respectively, with their stitch orders reversed sidewise. Then, their conditions immediately before the binding-off are as shown, for example, in FIG. 16 or FIG. 18. As the face/back conditions of the respective collars have been reversed by said transfers, the portions apparent around the connection parts of the collar in FIG. 16 and FIG. 18 are basically inconspicuous parts inside the collar. When the binding-off is made in these areas, the protruding part resulting from the binding-off is hidden behind the collar, and is not conspicuous.

The back collar is knitted continuous to both the right collar and the left collar, and, the binding-off may be made, for example, at the center of the back collar (see FIG. 18), or the back collar may be knitted continuous to one of the collars (see FIG. 16) . Preferably, as for the collar to be used as the basis for knitting the back collar, the stitch of the innermost wale is overlapped with the stitch of the side end of the collar knitting area. Next, whenever one course or two courses of the collar, for example, is knitted, the stitch of the innermost wale of the collar is overlapped with one stitch of the collar knitting area. The overlapping is made to a stitch of the collar knitting area, said stitch not being occupied by the back collar. Knitting of the specified number of courses of the back collar and overlapping with the collar knitting area are repeated. As a result, at one stitch on one side end of the collar knitting area, the innermost wale of the right collar or the left collar continues to the innermost wale of the back collar. Next, whenever a given number of courses of the back collar are knitted, the stitches of the innermost wale are overlapped with the stitches of the collar knitting area, and this connects the innermost wale of the back collar to the collar knitting area. Moreover, the top end of the back collar extends towards the other front collar. It should be noted that here the neck hole side of the collar is defined as the outer side, and the opposite side as the inner side, and the collar knitting area has, for example, two side ends corresponding to both the ends of the hole of the back body.

In this specification, for the wales around the collar, the neck hole side is defined as the outer side, and the opposite side, for example, the right body side or the left body side as the inner side. With regard to the knitting of the back collar, preferably, the stitch of the innermost wale of either the right collar or the left collar, at least, is overlapped with the stitch of one end of the collar knitting area. This knitting is illustrated, for example, by the course 14 of FIG. 10 and the course 10 of FIG. 20. After that, the stitches of the innermost wale of the back collar are overlapped with stitches of the collar knitting area. As a result, as shown in, for example, FIG. 10, the inside/outside order of wales is maintained for the entire circumference of the collar.

The right collar and the left collar are connected by the back collar. This process will be explained in relation to the needle beds. For example, every time two course (courses 15 through 18 of FIG. 11) or one course (the modification of Embodiment 2) of the back collar are knitted, the knitted back collar is moved by racking a needle bed and transfer. Thus, every time the back collar is knitted by a given number of courses, the back collar is moved over the needle beds, namely, the needles to which the back collar is held are changed. As a result, for example, if the back collar is knitted in succession to the right collar, the back collar shifts over the needle beds towards the left collar side as knitting proceeds. Preferably, every time such a transfer is made, the stitch of the innermost wale of the back collar is overlapped with one stitch of the collar knitting area. For example, in the courses 15 through 18 of FIG. 11, every time two courses of the back collar are knitted, the transfer is made to shift the back collar and the stitches of the innermost wale are overlapped with stitches of the collar knitting area.

When the knitting of the collar is completed, the ends are bound off. The binding-off is made in such a way that the inside-outside order of wales is maintained between the two ends. In principle, for all parts of the collar, the number of wales is identical. Hence the stitches of the innermost wales and the stitches of the outermost wales of the two ends are connected to each other, respectively. As mentioned above, if the orders of stitches of both the right collar and the left collar are reversed sidewise during transfer, the protruding part resulting from the binding-off is concealed on the inner side of the collar.

EMBODIMENT 1

Figure 1:
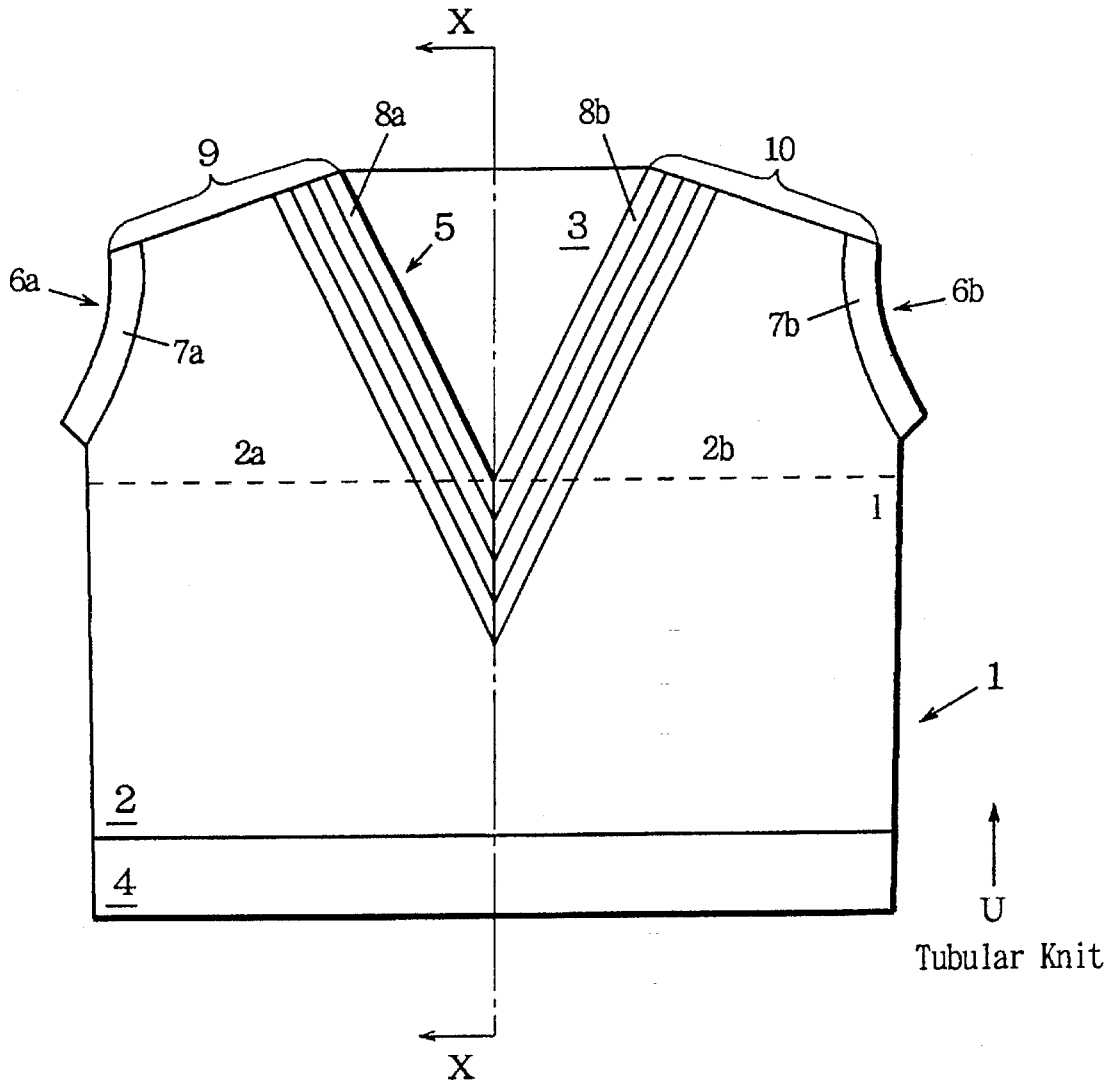
FIG. 1 is a plan view showing a vest 1 knitted in Embodiment 1 according to the present invention.
Figure 2:
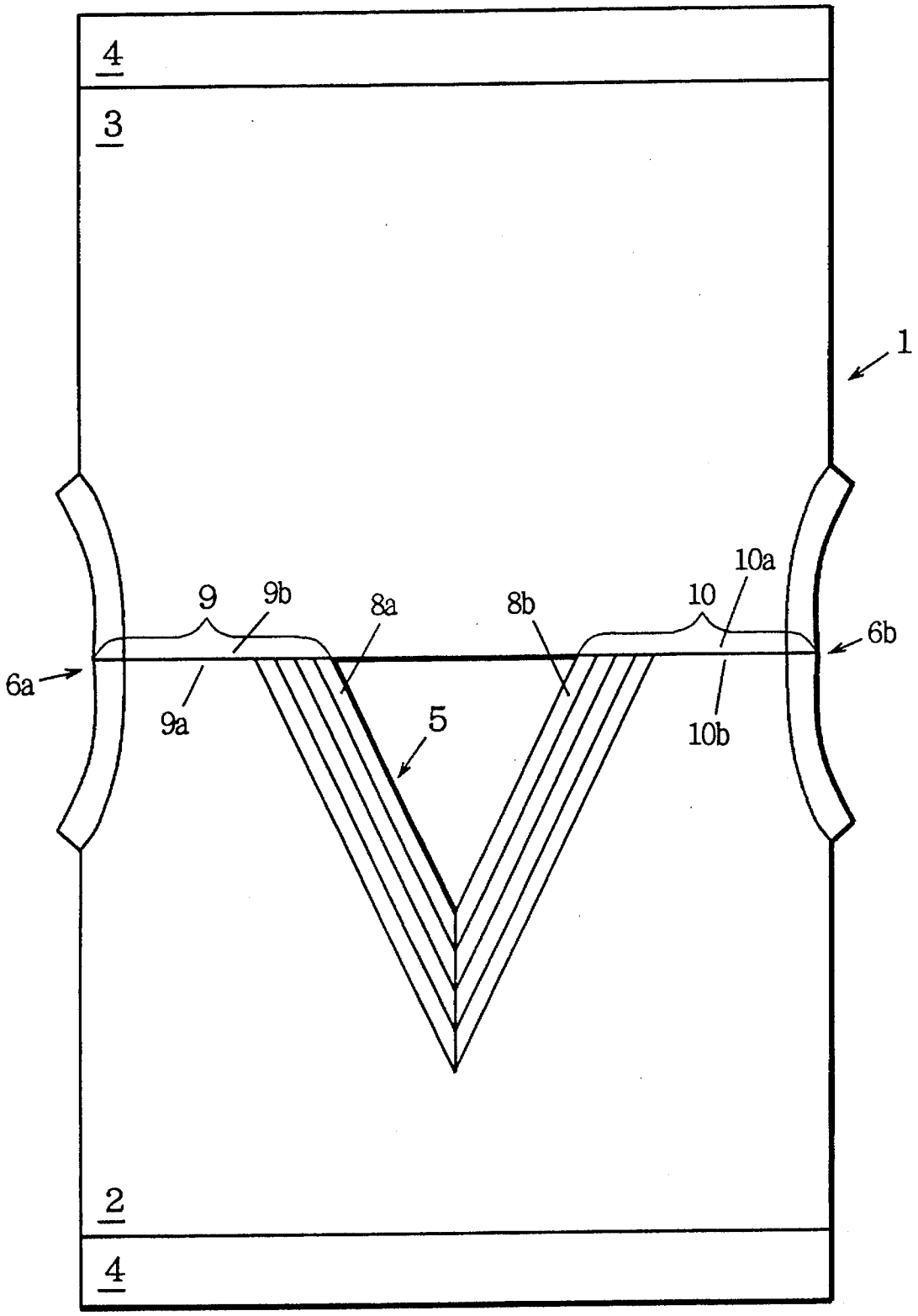
FIG. 2 is a development view showing the vest 1 of FIG. 1 cut along both the sides and developed.

The first embodiment according to the present invention will be described below with reference to the related diagrams. In the present invention, a flat knitting machine is used, wherein at least a pair of needle beds, front and rear, are provided and one or two needle beds are slidable sidewise. FIG. 1 shows a vest 1 to be knitted in this embodiment. FIG. 2 shows the vest 1 cut along both the sides and developed. The vest 1 is knitted in a cylindrical form; a front body 2 is knitted on the front needle bed and a back body 3 is knitted on the rear needle bed. The vest 1 is knitted from a bottom rib 4 in the direction of an arrow U. In the upper portion of the vest 1, a neck hole 5 and armholes 6*a*, 6*b* for putting through the left and right arms are formed. Sleeves 7*a*, 7*b* are formed around the armholes 6*a*, 6*b*, respectively. In the front body 2, the formation of the neck hole 5 is started from the position of a broken line 1. Above this line, the front body 2 is knitted in two parts, a right front body 2*a* and a left front body 2*b*, and a right collar 8*a* which will become a first collar and a left collar 8*b* which will become a second collar are knitted around the neck hole 5. These parts are knitted concurrently with other portions of the front body 2 and the back body 3. For portions wherein the neck hole 5 and the holes 6*a*, 6*b* are formed, different yarn feeders are used for the right front body 2*a*, the left front body 2*b*, and the back body 3, respectively. The knitting up to this stage is clear from Provisional Patent Publication No. HEI-4-153346, etc., and detailed description is not necessary. When the knitting of the front body 2 and the back body 3 is completed up to the shoulders, a right front shoulder 9*a* including the right collar 8*a* is overlapped with the final course of a right back shoulder 9*b*, and similarly a left front shoulder 10 including the left collar 8*b* is overlapped with a left back shoulder 10*b*, and the binding-off is made, which will be explained later. Then the fabric is removed from the needles.

Figure 3:
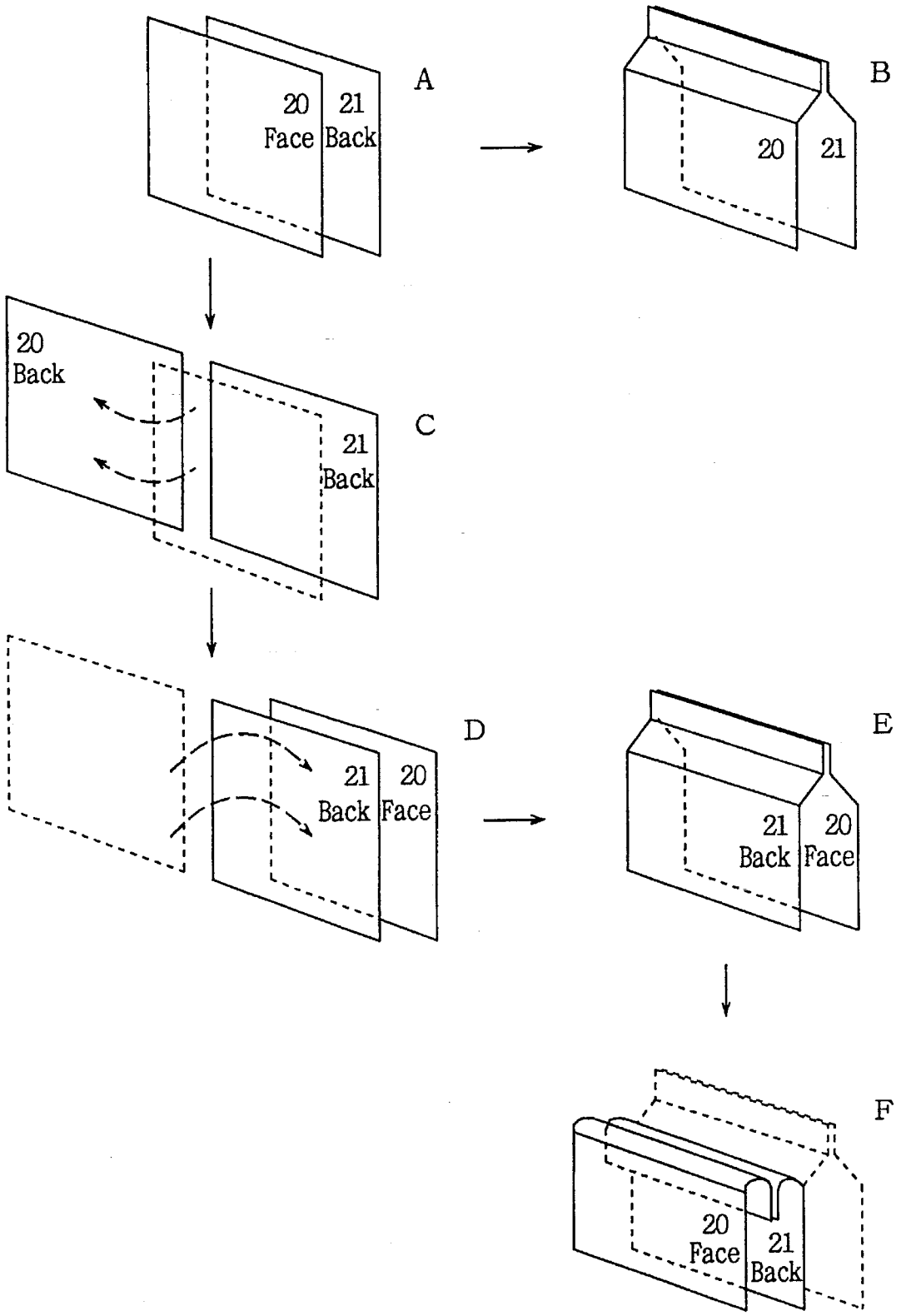
FIG. 3 is a diagram illustrating the movements of the fabrics in Embodiment 1.

Before describing the actual knitting of a vest, the knitting will be described in outline with reference to a schematic diagram. The knitting method is shown in FIG. 3. In FIG. 3A, a front fabric 20 and a back fabric 21 are opposed to each other, and the front fabric 20 is on the needles of the front bed and the back fabric 21 is on the needles of the rear bed; the stitches of their final courses are held. As shown in FIG. 3A, both the front fabric 20 and the back fabric 21 have their knits on the outer side and their purls on the inner side, wherein knits appear on the surface of the fabric after knitting and purls appear on the back. From this condition, the final courses of the front fabric 20 and the back fabric 21 are overlapped with each other and bound off. According to the conventional method, as shown in FIG. 3B, the stitches of the final courses of the front fabric 20 and the back fabric 21 are just overlapped with each other and bound off. In contrast to it, as shown in FIG. 3C, the front fabric 20 is rotated from the condition shown in FIG. 3A clockwise as seen from above by 180 degrees as shown by dotted lines to the condition indicated by the full line. Next, in FIG. 3D, the front fabric 20 is rotated from the condition of FIG. 3C shown by the dotted line clockwise by another 180 degrees to the condition shown by the full line. As a result, both the front fabric 20 and the back fabric 21 have their purls on the outer sides and their knits on the inner sides. Now, the stitches of the final courses of the front fabric 20 and the back fabric 21 are overlapped with each other and bound off to produce the condition shown in FIG. 3E. In FIG. 3E, both the front fabric 20 and the back fabric 21 are joined together with their purls appearing on the outer sides. Next, in FIG. 3F, the front fabric 20 and the back fabric 21 are turned over from the condition indicated by the dotted lines so that their knits appear on the outer sides. As a result, the binding-off portion is concealed in the back of the fabric as shown by full lines.

Figure 4:
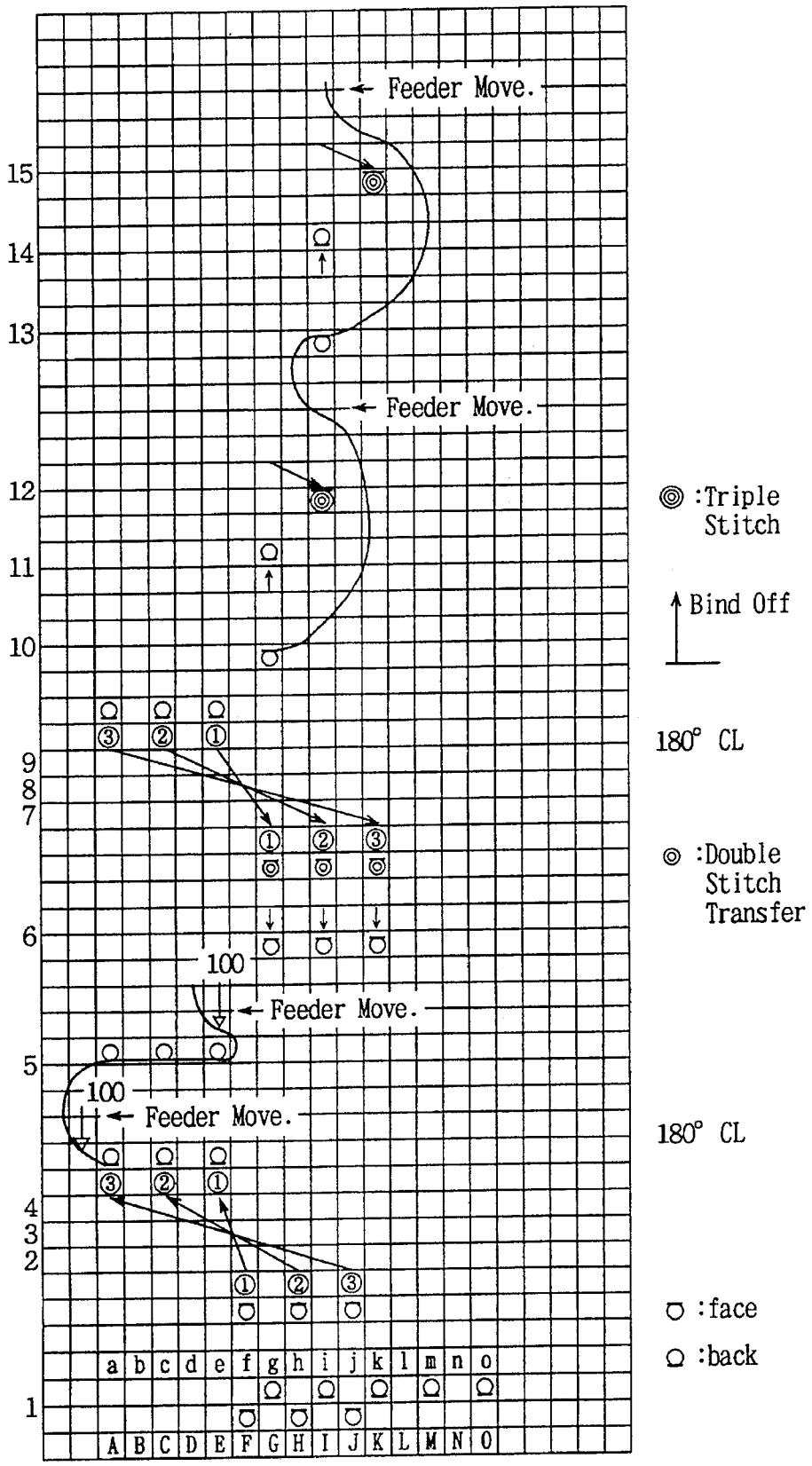
FIG. 4 and FIG. 5 are knitting course diagrams of Embodiment 1.
Figure 5:
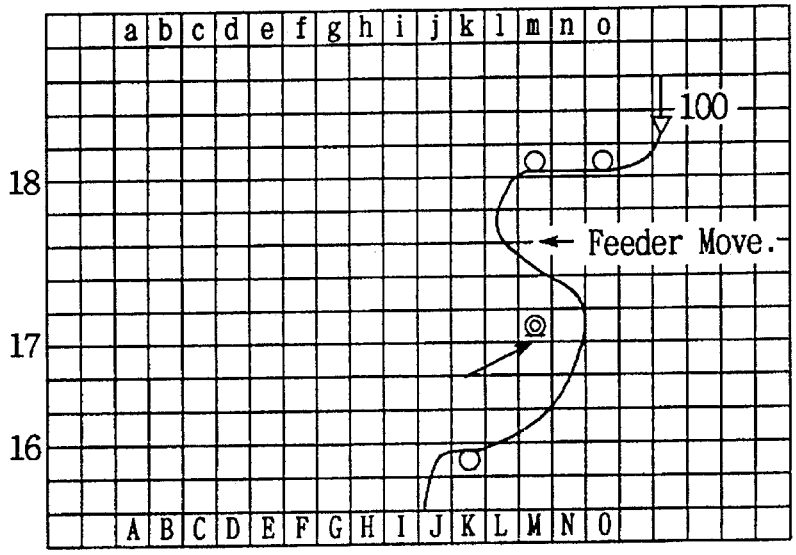

The first embodiment according to the present invention will be described by taking knitting of a vest 1 as an example. In the knitting courses of FIG. 4 and FIG. 5, numerals on the left end indicate course numbers. Capital letters of alphabet indicate needles of the front bed. Small letters of alphabet indicate needles of the rear bed. Arrows indicate directions of transfer. The course 1 of FIG. 4 shows the condition prior to binding-off at the right shoulder 9, and this corresponds to FIG. 3A. The knitting of the right shoulder 9 of the vest 1 is similar to that of the left shoulder 10 of the vest 1. Hence only the binding-off of the right shoulder 9 is described in the embodiment. In the knitting courses of FIG. 4 and FIG. 5, only the knitting on the left side of the line X—X of FIG. 1 is indicated. At this moment, the stitches of the right front shoulder 9*a* are held on needles F, H and J of the front bed, and the stitches of the right back shoulder 9*b* are held on needles g, i and k of the rear bed. The stitches of the final course of the back body 3 are held on needles m and o of the rear bed. Now, the right front shoulder 9*a* and the right back shoulder 9*b* are overlapped with each other with their knits appearing on the outer sides; they are being held on the needles of the front bed and the rear bed, respectively. Although it is not limitative but in the present embodiment a flat knitting machine having a pair of needle beds, front and rear, is used, and needles of even numbers, B, D, . . . of the front bed are used for knitting the front body 2, and needles of odd numbers, a, c, . . . of the rear bed are used for knitting the back body 3. Empty needles of the opposite needle bed are used for transfer, and stitches can be transferred sidewise in the tubular knitting process. A flat knitting machine with four beds may be used, wherein two pairs of needle beds, front and rear, are stacked in two stages, upper and lower. In this case, as needles of the upper beds can be used for transfer, both the front body and the back body can be knitted on the lower beds without keeping empty needles between stitches.

Figure 6:
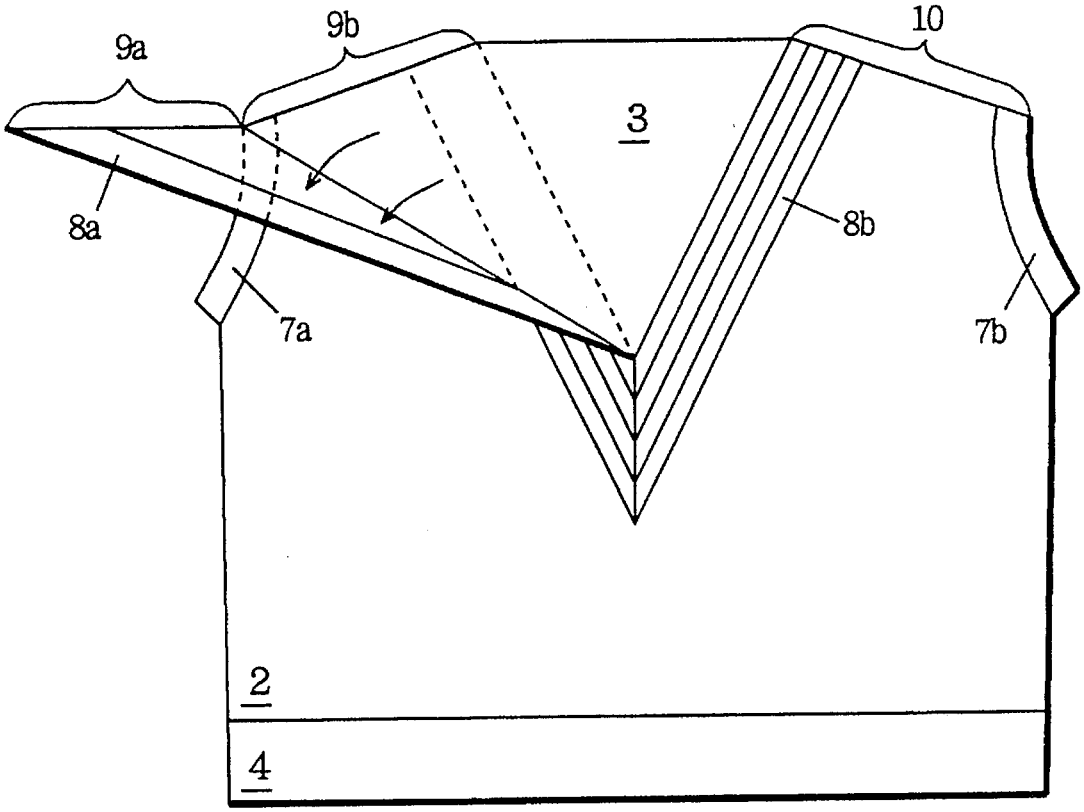
FIG. 6 is a plan view of the vest 1 at the time of completion of the course 4 of FIG. 5.
Figure 7:
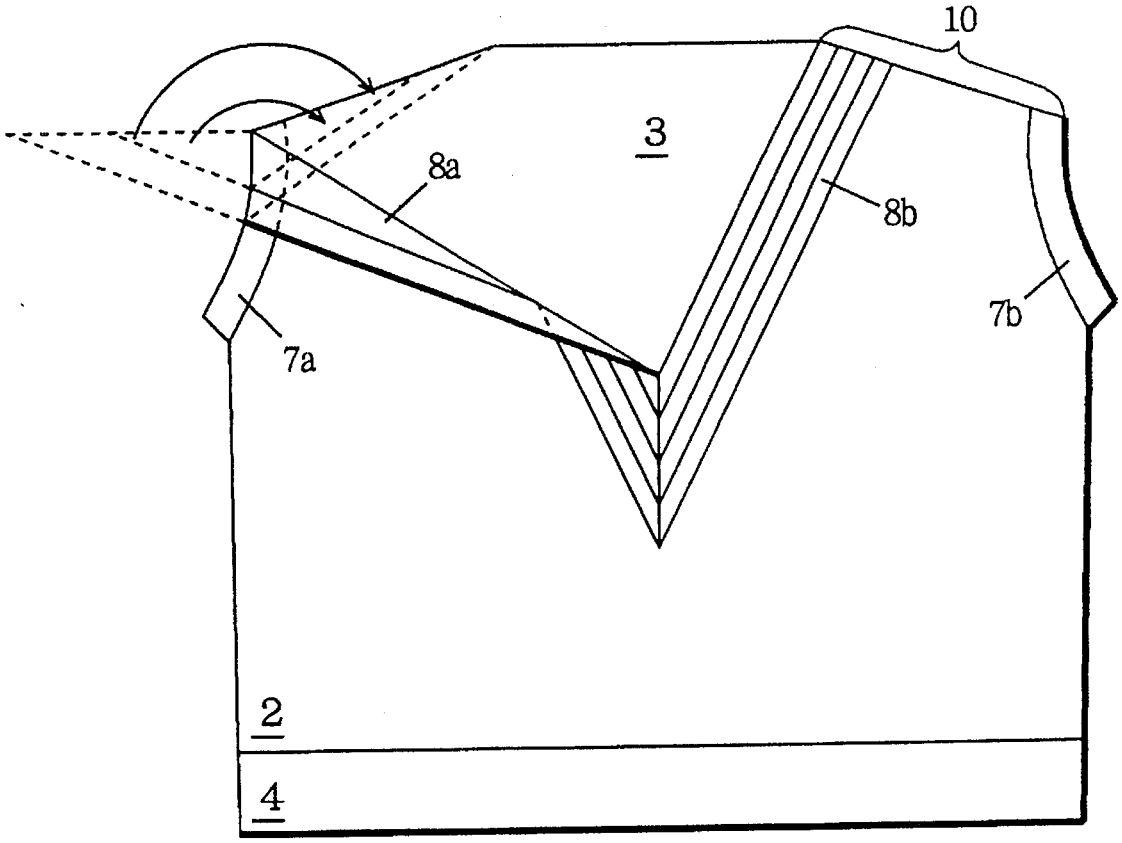
FIG. 7 is a plan view of the vest 1 at the time of completion of the course 9 of FIG. 5.

To bring from the condition shown in FIG. 3A to the condition shown in FIG. 3C, in the courses 2 through 4, the right front shoulder 9*a* is turned clockwise by 180 degrees; as a result, the order of stitches is reversed sidewise. Moreover, in these courses, the right front should 9*a* is moved to one side of the right back shoulder 9*b*. First, in the course 2, the stitch on the needle F of the front bed is transferred to the needle e of the rear bed. In the courses 2 through 4, an arrow indicates the transfer destination, and the numerals at the front and the tail of an arrow indicates the order of transfer. In the course 3, the stitch of the needle H of the front bed is transferred to the needle c of the rear bed, and in the course 4, the stitch on the needle J of the front bed is transferred to the needle a of the rear bed. As a result, as shown in FIG. 6, the right front shoulder 9*a* is turned clockwise by 180 degrees on the side end of the right back shoulder 9*b*. As a result, the order of stitches is reversed sidewise and the right front shoulder 9*a* is transferred to the needles of the read bed. This is the condition corresponding to FIG. 3C. Next, the yarn feeder 100 is shifted to the left, and in the course 5, the yarn feeder 100 is used to feed yarn to the needles a, c and e of the rear bed and knit the right front shoulder 9*a*. Next, the yarn feeder 100 is shifted to the left, and in the course 6, the stitches of the right back shoulder 9*b* being held on the needles g, i and k of the rear bed are transferred to the needles of the corresponding front bed. In the subsequent courses 7 through 9, the fabrics is changed from the condition shown in FIG. 3C to the condition shown in FIG. 3D. To be more specific, the right front shoulder 9*a* being held on the rear bed is turned clockwise by another 180 degrees to transfer the stitches sequentially to the needles of the front bed. As a result, the order of stitches of the right front shoulder 9*a* is reversed sidewise again, and the right front shoulder 9 overlaps with the right back shoulder 9*b*. First, in the course 7, the stitch of the right front shoulder 9*a* being held on the needle e of the rear bed is transferred to the needle G of the front bed and overlapped with the stitch of the right back shoulder 9*b*. In the course 8, the stitch on the needle c of the rear bed is transferred to the needle I of the front bed, and in the course 9, the stitch on the needle a of the rear bed is transferred to the needle K of the front bed. As a result, as shown in FIG. 7, in the vest 1, the right front shoulder 9*a* and the right back shoulder 9*b* are overlapped with each other, with their purls being exposed on the outer sides.

Next, from the condition shown in FIG. 3D, the final courses of the right front shoulder 9*a* and the right back shoulder 9*b* being overlapped with each other are bound off. First, in the course 10, a yarn is fed to the needle G of the front bed to form a stitch. Next, in the course 11, the stitch being newly formed in the course 10 is transferred to the needle g of the rear bed, and in the course 12, the stitch is further transferred to the needle I of the front bed. As a result, on the needle I of the front bed, the stitch of the right front shoulder 9*a*, the stitch of the right back shoulder 9*b* and the stitch of the next course newly formed in the course 10 are overlapped with each other. Next, the yarn feeder 100 is shifted to the left, then in the course 13, the yarn is fed to the needle I of the front bed to form a stitch. Next, in the course 14, the stitch newly formed in the course 13 is transferred to the needle i of the rear bed, and in the course 15, the stitch is further transferred to the needle K of the front bed. As a result, the stitch of the right front shoulder 9*a*, the stitch of the right back shoulder and the stitch newly formed are overlapped with each other. Then, the yarn feeder 100 is shifted to the left, and in the course 16 of FIG. 5, yarn is fed to the needle K of the front bed on which three stitches are held to form a stitch of the next course. After that, the stitches of the right front shoulder 9*a* and the right back shoulder 9*b* held on the needles in the course 1 are removed the needles, except the stitches held on the needle K of the front bed. Next, in the course 17, the stitches held on the needle K of the front bed is transferred to the needle m of the rear bed. In the course 18, the yarn is fed to the needles m and o of the rear bed to form stitches. As a result, the stitches of the right front shoulder 9*a* and the right back shoulder 9*b* are bound off, and are removed from all the needles. After that, in a similar manner, the final courses of the left shoulder 10 and the back body 3 are bound off to complete the knitting of the vest 1.

The bound-off vest 1, as shown in FIG. 3E, has all the binding-off portions exposed on the outer surfaces of the fabric at the time of completion of knitting. However, as the binding-off is made with the purls of the fabrics appearing on the outer surfaces in the process of knitting, when the fabric is turned over, the binding-off portions are concealed in the back of the fabric. Accordingly, the chain stitches formed in the binding-off portions do not appear on the surface of the fabric, and the binding-off portions do not protrude.

In the embodiment, in the courses 7 through 9 of FIG. 4, all the stitches of the right front shoulder 9*a* are overlapped with the right back shoulder 9*b*, then the stitches of the next course are formed to remove the stitches from the needles. However, the following knitting is also possible. In the course 7, the stitch of the needle e of the rear bed is transferred to the needle G of the front bed to overlap the stitches with each other, after that, yarn is fed to the needle G of the front bed to form the stitch of the next course. Next, the stitch of the needle c of the rear bed is transferred to the needle I of the front bed to overlap stitches with each other. Next, the stitch newly formed on the needle G of the front bed is transferred, via the needle g of the rear bed, to the needle H of the front bed to overlap the three stitches with each other. After that, the stitch of the next course is formed. In this case, the transfer for overlapping the right front shoulder 9*a* with the right back shoulder 9*b* and the formation of the stitch of the next course on the overlapped stitches can be made in parallel.

Modification

Figure 8:
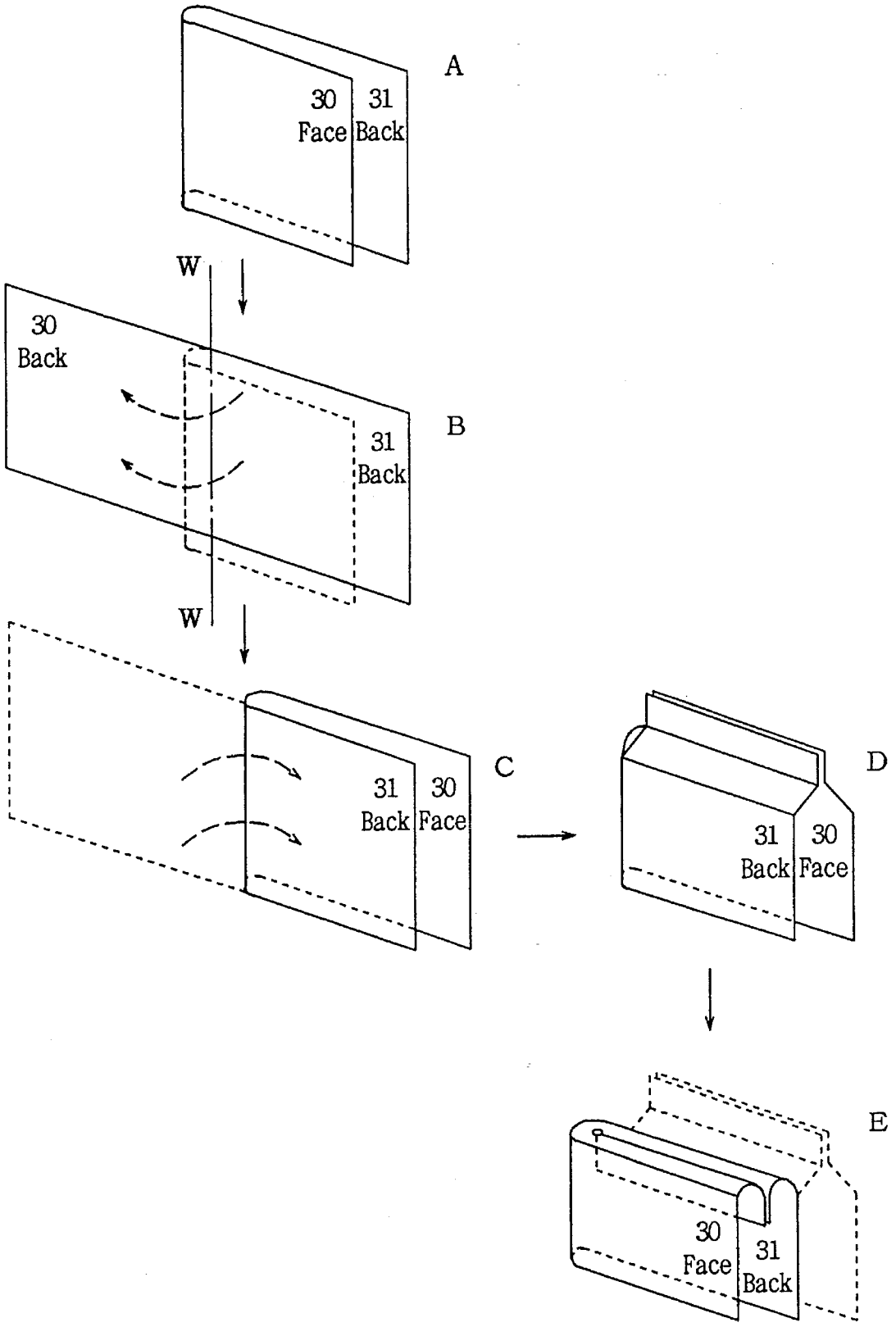
FIG. 8 is a diagram illustrating the movements of the fabrics in the modification of Embodiment 1.

In the embodiment, the right front shoulder 9*a* and the right back shoulder 9*b* is not continuous at their ends. However, as shown in FIG. 8, it is possible to knit the front fabric 30 and the back fabric 31 in continuation with each other across a boundary line W—W and further connect them with each other. In the embodiment, when one fabric of a pair of fabrics is transferred to the opposing needle bed, the stitches are transferred symmetrically with the boundary line as the center, starting from the stitch near to the boundary towards the stitches distant from the boundary. With this method, the shoulders of the sweater, for example, can be connected.

EMBODIMENT 2

Figure 9:
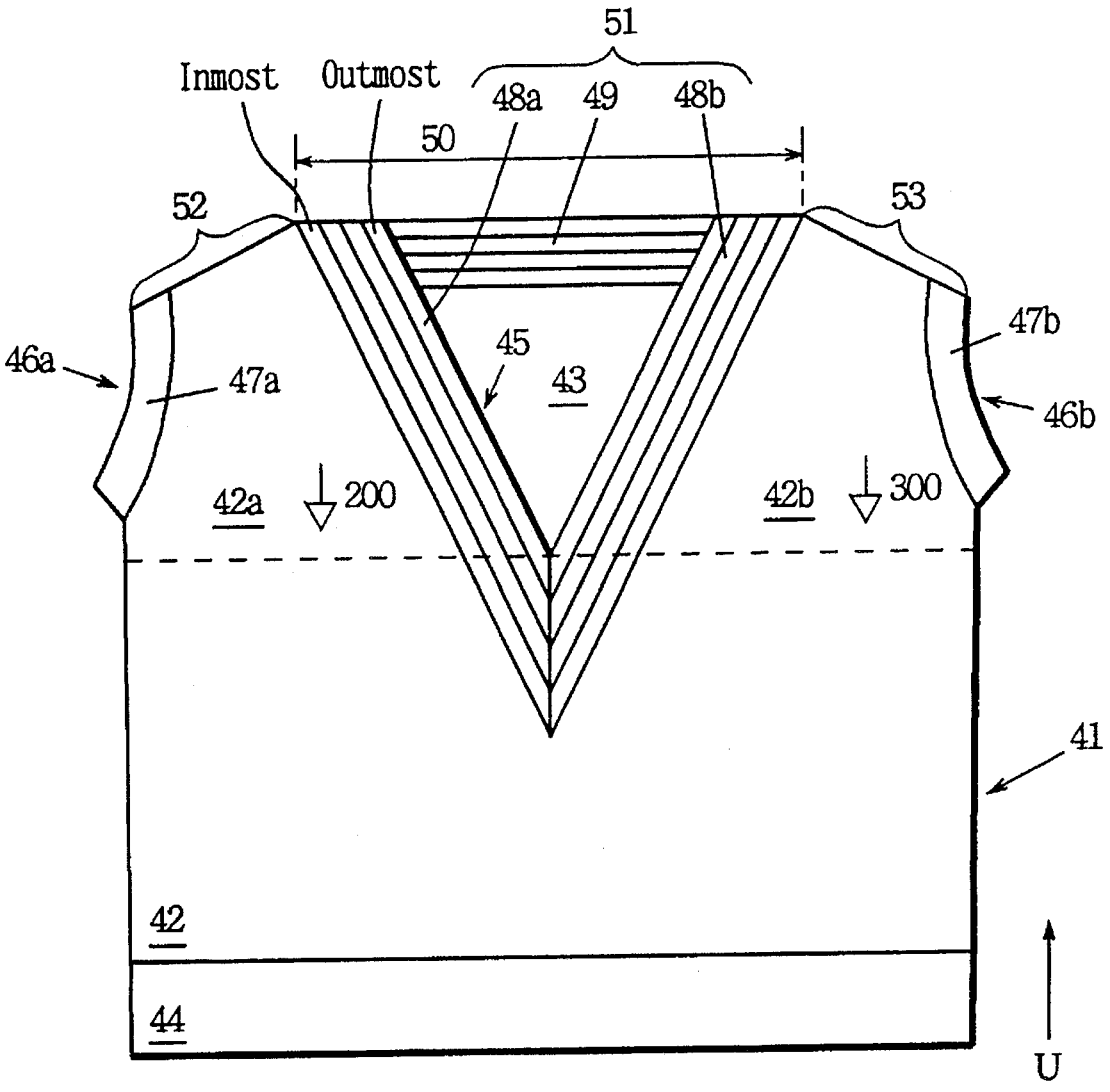
FIG. 9 is a plan view of a vest 41 knitted in Embodiment 2 according to the present invention.
Figure 10:
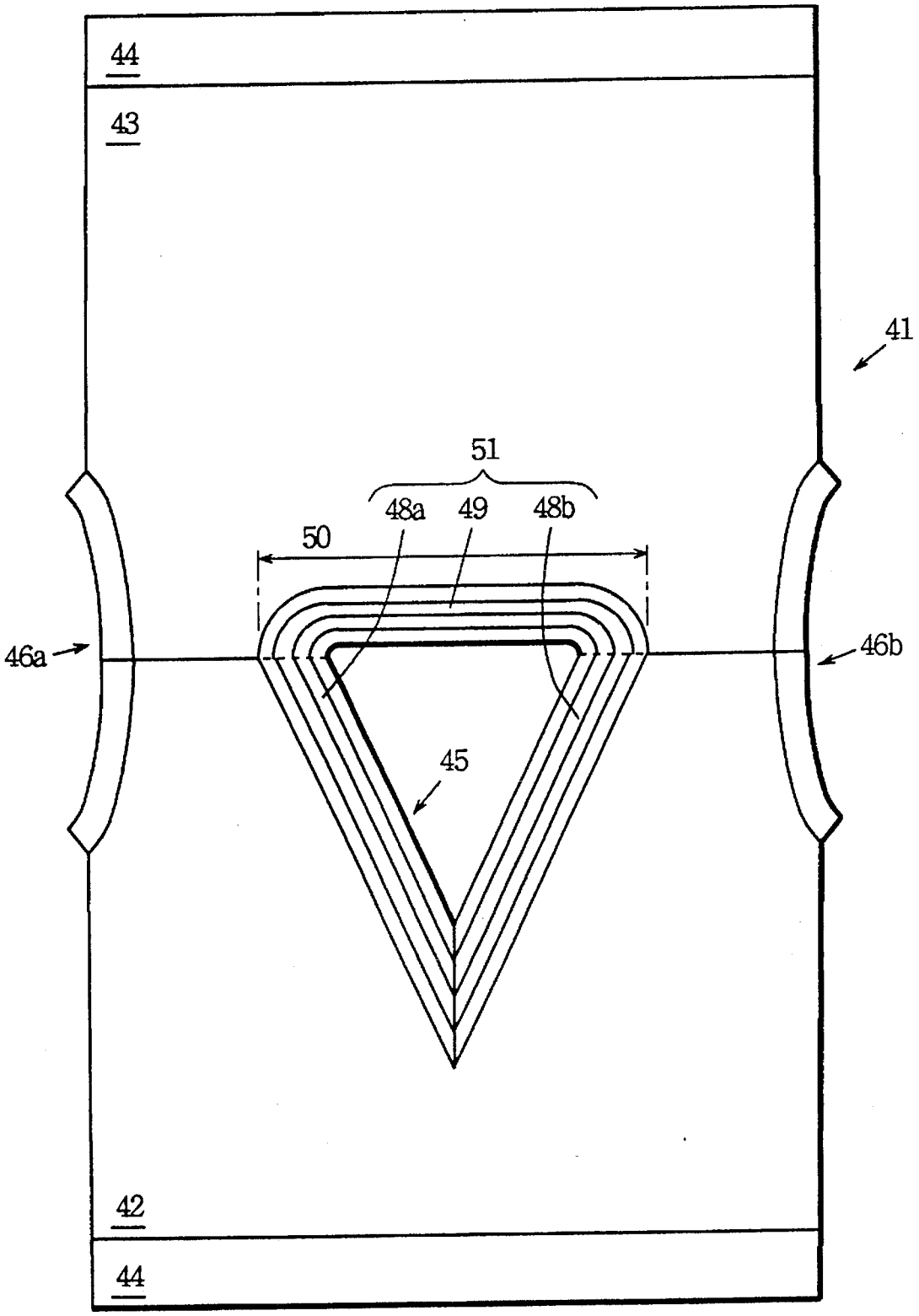
FIG. 10 is a development view showing the vest 41 of FIG. 9 cut along both the sides and developed.

The second embodiment according to the present invention will be described below. In Embodiment 2, a collar of which wales' directions are continuous is formed around a neck hole, etc. of a pair of fabrics knitted in an overlapping position, front and back. It is common to both Embodiment 2 and Embodiment 1 that a fabric is transferred to the opposing needle bed with the order of stitches of the fabric reversed sidewise. FIG. 9 shows a vest 41 knitted according to Embodiment 2, and FIG. 10 shows the vest 41 cut along its sides and developed. In the vest 41, similarly to the vest 1 of Embodiment 1, the front body 42 and the back body 43 are knitted cylindrically, and the bottom rib 44, the neck hole 45, arm holes 46*a*, 46*b*, and sleeves 47*a*, 47*b* are formed similarly. However, in the vest 41 of Embodiment 2, in contrast to Embodiment 1, the back collar 49 is formed on the collar knitting area on the final course of the back body 43. The back collar 49 is connected to the right collar 48*a* and the left collar 48*b* both formed on the front body 42, and the right collar 48*a*, the left collar 48*b* and the back collar 49 are knitted continuously to form the collar 51. In the vest 41, the wale directions of the right collar 48*a* and the left collar 48*b* both formed on the front body 42 are identical to those of the front body 42, but the wale directions of the back collar 49 are perpendicular to the wale directions of the back body 43. The wale directions of the right collar 48*a*, the left collar 48*b* and the back collar 49 are continuous. Embodiment 2 will be described by taking the vest 41 as an example. The collar is, for example, a plain stitch fabric having three wales. With regard to the outside and the inside of the collars, the neck hole side is defined as the outer side, and the body side as the inner side.

Figure 11:
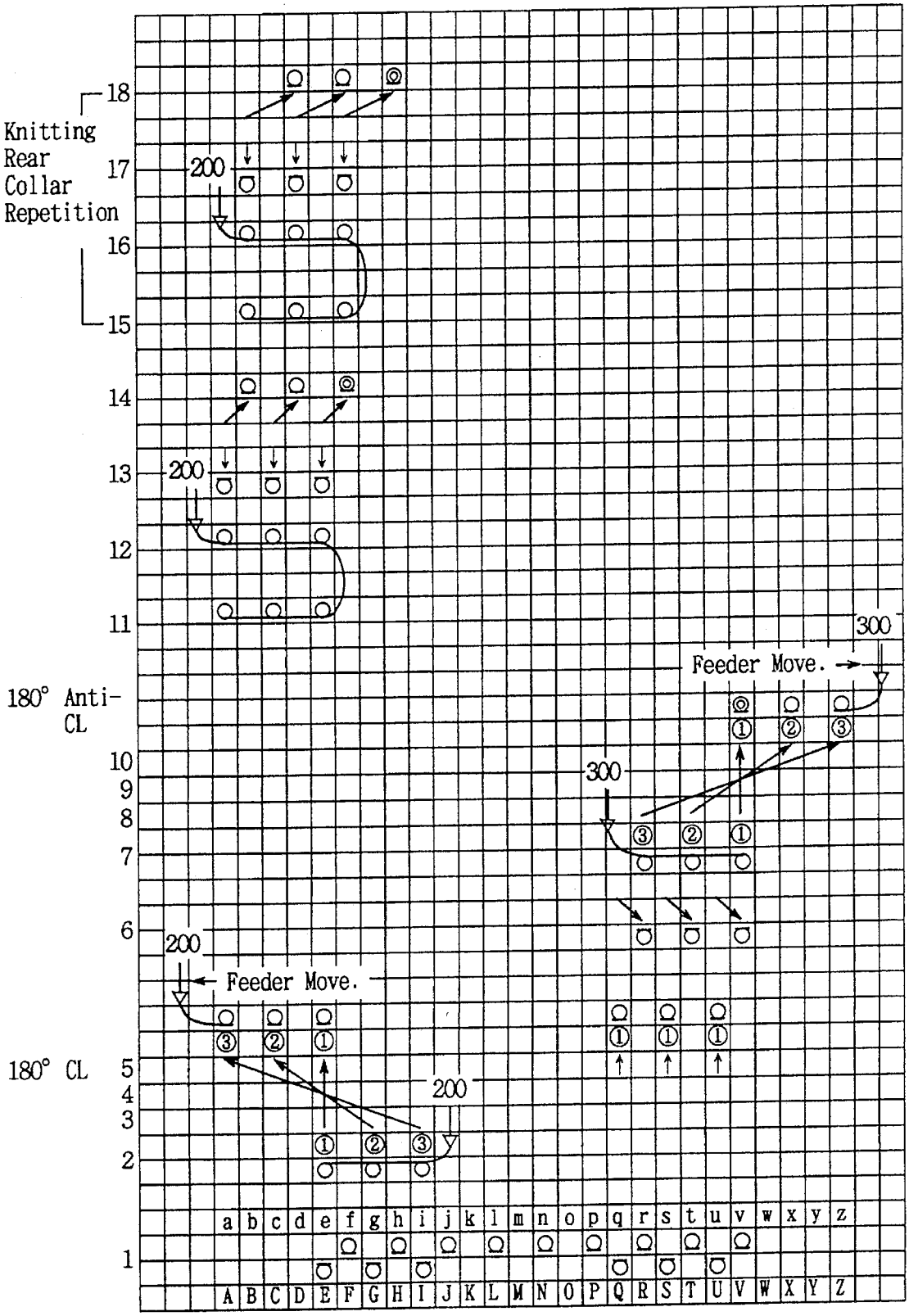
FIG. 11 through FIG. 13 are knitting course diagrams of Embodiment 2.

The course 1 of FIG. 11 shows the condition of the vest 41 of FIG. 9, wherein the vest 41 has been knitted up to both the left and right shoulders 52, 53, the front body 42 and the back body 43 have been joined and bound off, and the stitches of the shoulders have been removed from the needles. In Embodiment 2, in succession to the right collar 48*a* and the left collar 48*b*, the back collar 49 is formed, and the right front shoulder 52*a* and the left front shoulder 53*a* do not contain the right collar 48*a* and the left collar 48*b*, respectively. In the condition shown in the course 1, on the front bed, stitches of the right collar 48*a* formed on the right front body 42*a* are held on the odd number needles E. G and I, and the stitches of the left collar 48*b* formed on the left front body 42*b* are held also on odd number needles Q, S and U. In between them there are needles J through P of the front bed, which correspond to the neck hole 45 of the front body 42. On the rear bed, the stitches of the collar knitting area 50 for forming the back collar 49 on the back body 43 are held on the even number needles f, h, . . . t and v. The shoulders 52, 53 may be bound off by the well-known method, or they may be bound off by the method shown in Embodiment 1.

Figure 14:
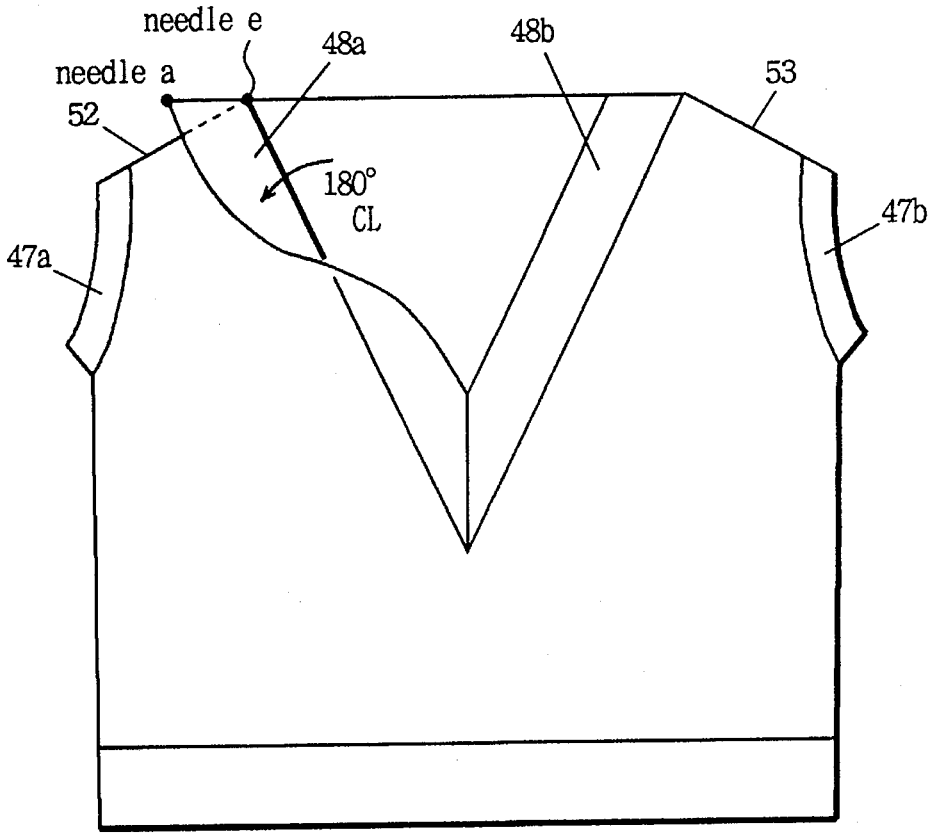
FIG. 14 is a plan view of the vest 41 at the time of completion of the course 5 of FIG. 11.
Figure 15:
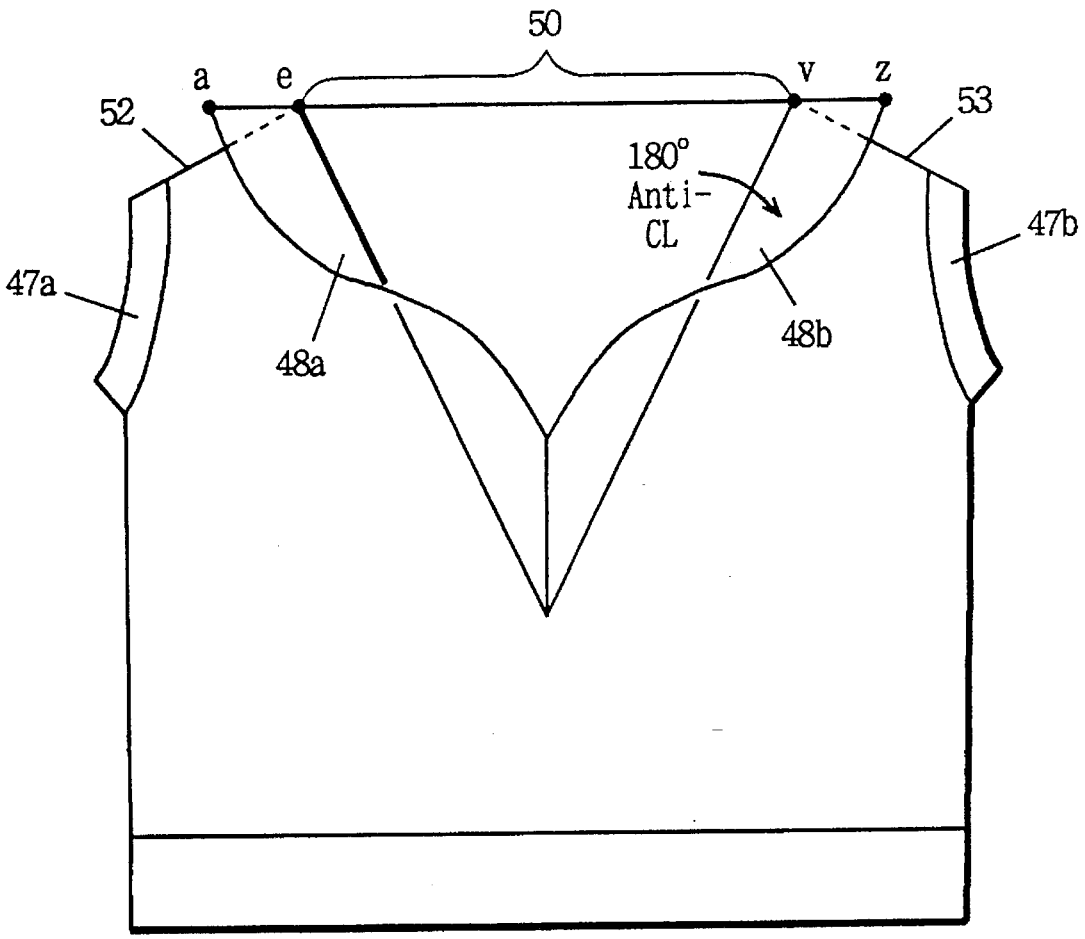
FIG. 15 is a plan view of the vest 41 at the time of completion of the course 10 of FIG. 11.

Next, in the course 2, yarn is fed to the needles E, G and I of the front bed by .the yarn feeder 20, which has been used for knitting the right front body 42*a*, to form stitches. Next, in the courses 3 through 5, the right collar 48*a* is turned clockwise by 180 degrees to reverse the order of stitches sidewise. And the right collar 48*a* is transferred to the side of the collar knitting area 50 on the rear bed. Here, the transfer is made in an order starting from the stitch on the needle E of the innermost wale of the right collar 48*a* and ending with the stitch on the needle I of the outermost wale. First, in the course 3, the stitch on the needle E of the front bed is transferred to the needle e of the rear bed. At this time, to prevent the yarn from breaking during racking, for transfer, of the front and rear beds in the later courses 4 and 5, in the course 3, just when the stitch of the needle E is transferred, the stitches of the left collar 48*b* held on the needles Q, S and U of the front bed are transferred to the corresponding needles q, s and u of the rear bed. Next, in the course 4, the stitch on the needle G of the front bed is transferred to the needle c of the rear bed, and in the course 5, the stitch on the needle I of the front bed is transferred to the needle a of the rear bed. As mentioned above, the right collar 48*a* is sequentially transferred to the outer side of the collar knitting area 50 of the back body 43 with the order starting from the stitch on the needle E of the innermost wale and ending with the stitch on the needle I of the outermost wale. As a result, as shown in FIG. 14, the order of stitches of the right collar 48*a* is reversed sidewise and the right collar 48*a* is turned clockwise by 180 degrees and transferred to the rear bed. The stitch of the outermost wale of the right collar 48*a* is held on the needle a of the rear bed, and the stitch of the innermost wale is held on the needle e. The right collar 48*a* abuts the collar knitting area 50.

Next, the yarn feeder 200 is moved to a position in which it does not interfere with the knitting, then in the course 6, the above-mentioned stitches of the left collar 48*b* that have been transferred to the rear bed are transferred back to the needles R, T and V of the front bed. In the course 7, yarn is fed by the yarn feeder 300, which have been used in knitting the left front body 42*a*, to the needles V, T and R of the front bed to form stitches. Next, in the courses 8 through 10, in direct contrast to the right collar 48*a*, the left collar 48*b* is turned counterclockwise to reverse the order of stitches sidewise. The left collar 48*b* is transferred to the side of the collar knitting area 50. First, in the course 8, the stitch on the needle V of the innermost wale of the left collar 48*b* is transferred and made to overlap with the stitch held on the needle v being located at the side end of the collar knitting area 50 of the back body 43. Then in the course 9, the stitch on the needle T is transferred to the needle x, and in the course 10, the stitch on the needle R of the outermost wale of the left collar 48*b* is transferred to the needle z. As a result, the vest 41 comes to abut on the outer side of the collar knitting area 50, with the orders of stitches of both the right collar 48*a* and the left collar 48*b* reversed sidewise.

In the course 11 and the course 12, yarn is fed by the yarn feeder 200 to the needles a, c and e of the rear bed to knit the right collar 48*a*. Next in the course 13, the stitches of the right collar 48*a* are transferred to the needles A, C and E of the front bed. The needle bed is racked, then in the course 14, these stitches are transferred to the needles b, d and f of the rear bed. At the time, as the stitch of the side end of the collar knitting area 50 is held on the needle f, the stitch of the collar knitting area 50 and the stitch of the innermost wale of the right collar 48*a* are overlapped with each other on the needle f. Next, in the course 15 and the course 16, yarn is fed by the yarn feeder 200 to the needles, b, d on which the stitches of the right collar 48*a* are held and to the needle f on which the overlapped stitches are held, to form stitches. As a result, the stitch of the innermost wale of the right collar 48*a* formed on the right front body 42*a* is connected to the stitch located to the side end of the collar knitting area 50. After that, the right collar 48*a* is knitted on the collar knitting area 50 as the back collar 49.

Next, in the course 17, the newly formed stitches of the back collar 49 are transferred from the needles b, d and f to the needles B, D and F. In the course 18, the front and rear beds are moved relatively to each other, then the stitches of the back collar 49 are transferred to the needles d, f and h. As a result, the stitch of the collar knitting area 50 held on the needle h and the stitch of the innermost wale of the back collar 49 are overlapped with each other. In the course 19 and the course 20, yarn is fed by the yarn feeder 200 to the needles d, f and h to form stitches, and as a result, the back collar 49 is knitted. By this, the collar is formed on two wales of the collar knitting area 50 of the back body 43. Subsequently, the knitting shown from the course 15 through the course 18 is repeated for an appropriate number of times to form the back collar 49 on the collar knitting area 50. Thus the condition shown in the course 24 of FIG. 12 is reached.

Figure 12:
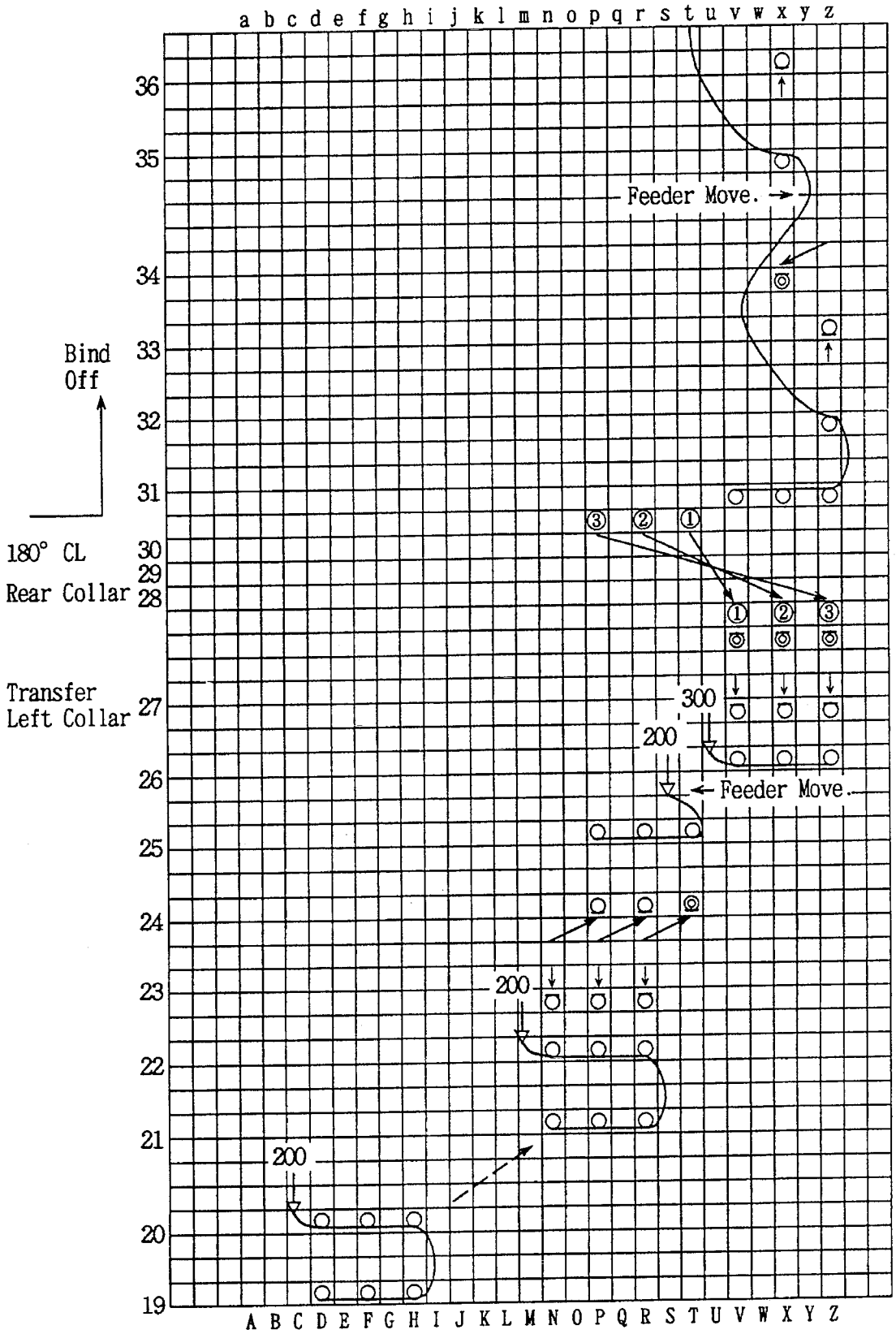
Figure 16:
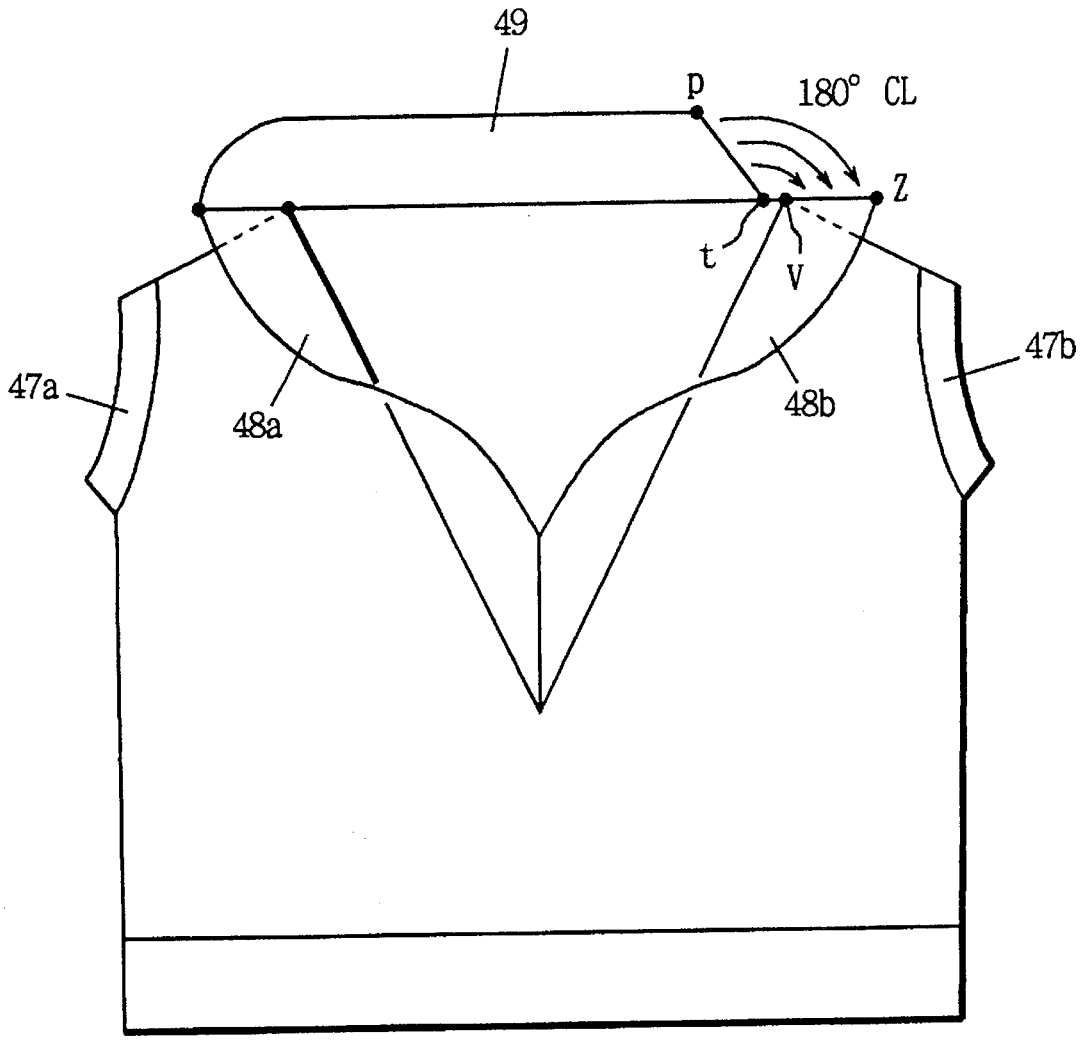
FIG. 16 is a plan view of the vest 41 at the time of completion of the course 26 of FIG. 12.

Next, in the course 24 of FIG. 12, the stitch of the innermost wale of the back collar 49 is overlapped with the stitch of the back body 43 held on the needle t of the collar knitting area 50. In the course 25, yarn is fed to the needles p, r and t, on which the stitches of the back collar 49 are held, to form stitches. After that, the yarn feeder 200 is moved to a position at which it does not interfere with the knitting. In the course 26, yarn is fed by the yarn feeder 300 to the needles v, x and z, on which the stitches of the left collar 48 are held, to form stitches. At the time, the stitch of the innermost wale of the left collar **48*b* and the stitch of the side end of the collar knitting area 50 are overlapped with each other on the needle v of the rear bed. Hence the formation of a new stitch joins the left collar 48*b* and the back body 43. As shown in FIG. 16, the stitch of the outermost wale of the back collar 49 is held on the needle p of the rear bed, and the stitch of the innermost wale is held on the needle t. The stitch of the outermost wale of the left collar 48*b* is held on the needle z of the rear bed, and the stitch of the innermost wale is held on the needle v. Thus the back collar 49 being formed on the collar knitting area 50 of the back body 43 abuts the left collar 48*b***.

Figure 17:
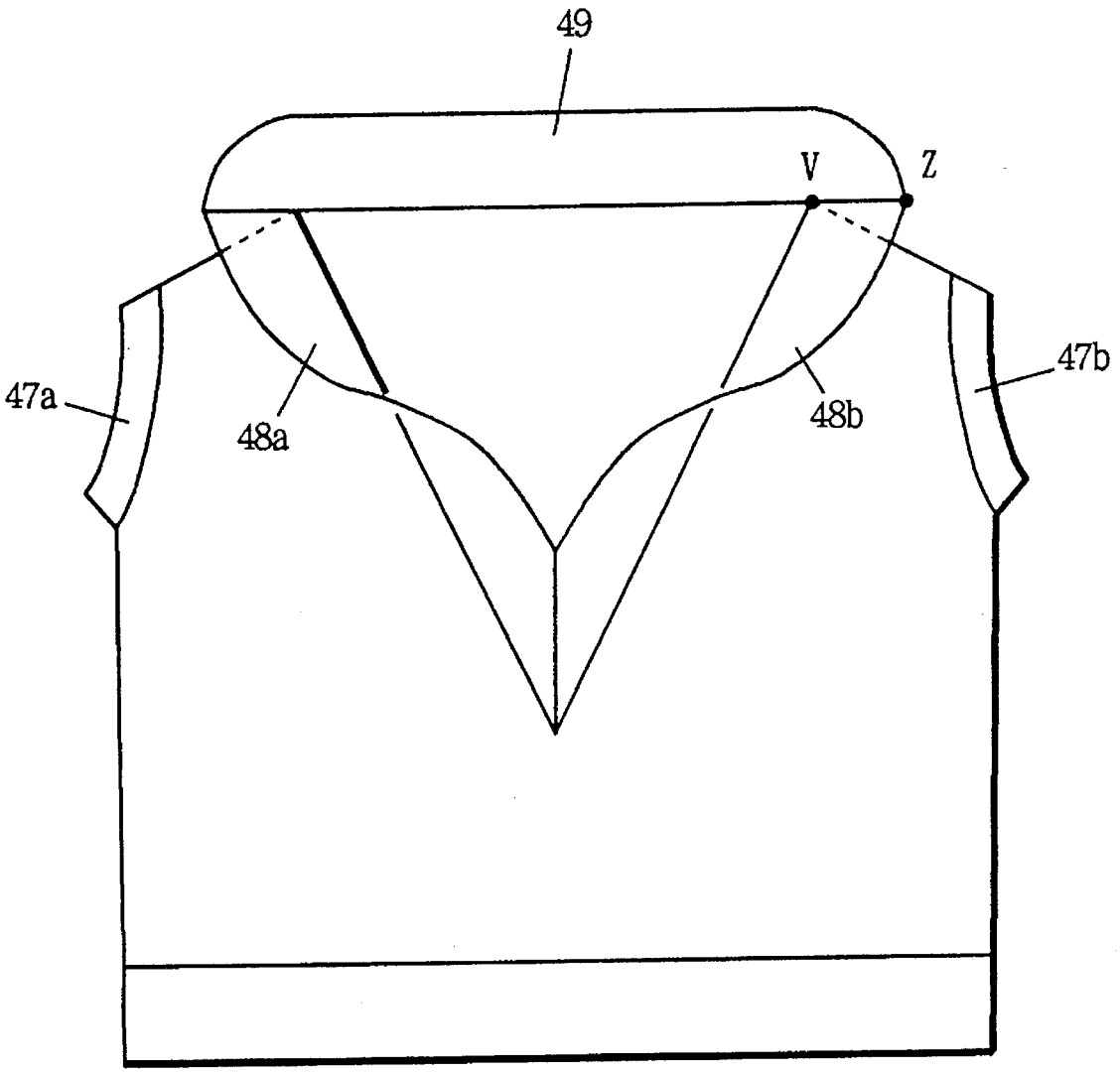
FIG. 17 is a plan view of the vest 41 at the time of completion of the course 30 of FIG. 12.

Next, in the course 27, the stitches of the left collar **48*b* held on the needles v, x and z of the rear bed are transferred to the corresponding needles V, X and Z of the front bed. Next, in the course 28 through the course 30, the back collar 49 is turned clockwise by 180 degrees to transfer to the front bed. As a result, the order of stitches of the back collar is reversed sidewise to overlap with the left collar 48*b*. This results in overlapping of the stitches of the outermost wales and of the stitches of the innermost wales of both the back collar 49 and the left collar 48*b*. First, in the course 28, the stitch of the innermost wale of the back collar 49 held on the needle t is overlapped with the stitch of the innermost wale of the left collar 48*b* held on the needle V. Next, in the course of 29, the stitch on the needle r of the rear bed is overlapped with the stitch on the needle X of the front bed. In the course 30, the stitch of the innermost wale of the back collar 49 on the needle p of the rear bed is overlapped with the stitch of the outermost wale of the left collar 48*b* on the needle Z of the front bed. Thus in the course 28 through the course 30, the back collar 49 with the order of stitches reversed sidewise is overlapped with the left collar 48*b* to make the condition of FIG. 17. As a result, the back collar 49 and the left collar 48*b* of the vest 41** are overlapped with each other, with the backs of the fabrics being exposed on the outer side.

Figure 13:
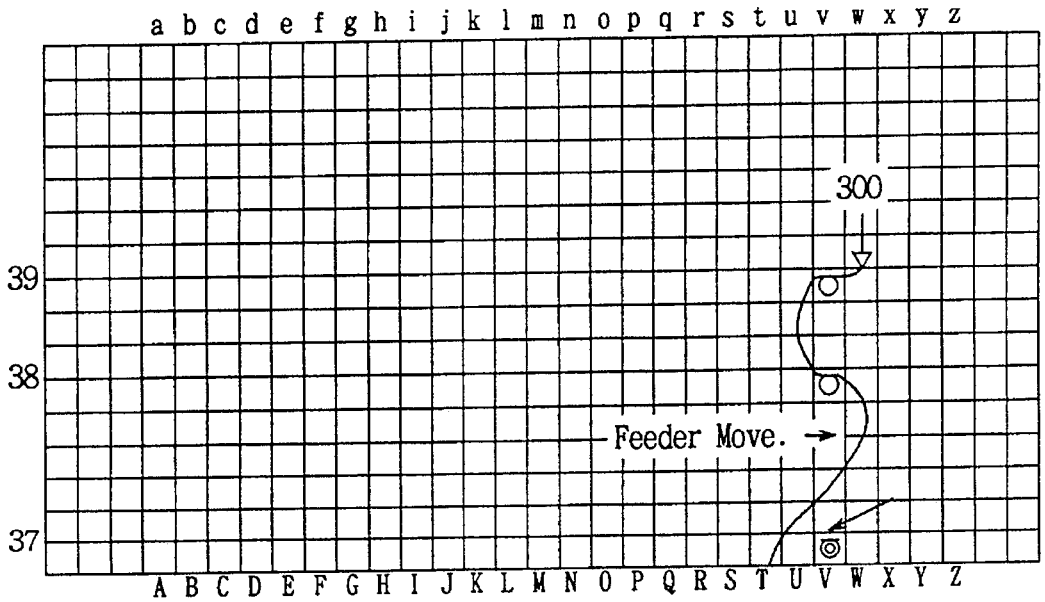

Next, the stitches of the final courses of both the back collar 49 and the left collar **48*b* are joined and bound off. First, in the course 31, yarn is fed by the yarn feeder 300, which has been used in knitting the back collar 49, to the needles V, X and Z of the front bed to form stitches. Next, in the course 32, yarn is fed by the yarn feeder 300 to the needle Z of the front bed to form a stitch. In the course 33, the stitch of the needle Z is transferred to the corresponding needle z. After racking, in the course 34, this stitch is overlapped with the stitch held on the needle X of the front bed. Next, the yarn feeder 300 is shifted to the right side of the needle X. Then in the course 35, yarn is fed by the yarn feeder 300 to the needle X of the front bed. As a result, the stitch being held on the needle Z of the front bed is held by the stitch newly formed on the needle X, and then removed from the needle. Next, in the course 36, the stitch on the needle X of the front bed is transferred to the corresponding needle of the rear bed. After racking, in the course 37 of FIG. 13, this stitch is transferred back to the needle V of the front bed. Then the yarn feeder is moved to the right side of the needle V. After that, in the course 38, yarn is fed by the yarn feeder 300 to the needle V of the front bed. Further, in the course 39 and beyond, yarn is fed to the needle V for an appropriate number of times. Then the stitch is removed from the needle V of the front bed to complete the knitting of the vest 41. The portions bound off in the course 31 through the course 39 are concealed in the back of the fabric when the fabric is turned over after knitting. The stitches of the innermost wale of the back collar 49 formed on the collar knitting area 50 of the back body 43 are joined to the back body 43, and the back collar 49 is knitted while it moves towards the left collar 48*b*. Hence the wale directions of the back body and the wale directions of the back collar 49** are perpendicular to each other when the knitting is completed.

As mentioned above, in Embodiment 2, the vest 41 is knitted in the following manner, the front body 42 and the back body 43 are joined together at both the left and right shoulders 52, 53. After that, the orders of stitches of the right collar **48*a* and the left collar 48*b* are reversed sidewise, and they are made to abut the outer sides of the collar knitting area 50. Now, the stitches of the innermost wales of the right collar 48*a* and the left collar 48*b* overlap with the stitches of the collar knitting area 50. The back collar 49 is knitted while it is moved towards the left collar 48*b*. After that, the final courses of the two collars are joined together in such a way that the stitches of the outermost wales overlap with each other and the stitches of the innermost wales overlap with each other, respectively. As shown in FIG. 10, the vest 41, after the completion of knitting, has a ring-shaped collar 51 on the circumference of the neck hole 5. Said collar 51 is knitted continuously and its wale directions are continuous. As the back collar 49 formed on the back body 43 is knitted in succession to the right collar 48*a*, the wale directions of both the collars are continuous. As the back collar 49 and the left collar 48*b* are joined together and the stitches of the outermost wales and the stitches of the innermost wales of their final courses are overlapped with each other, respectively, the wale directions of both the back collar 49 and the left collar 48*b*** are continuous.

Modification

Figure 18:
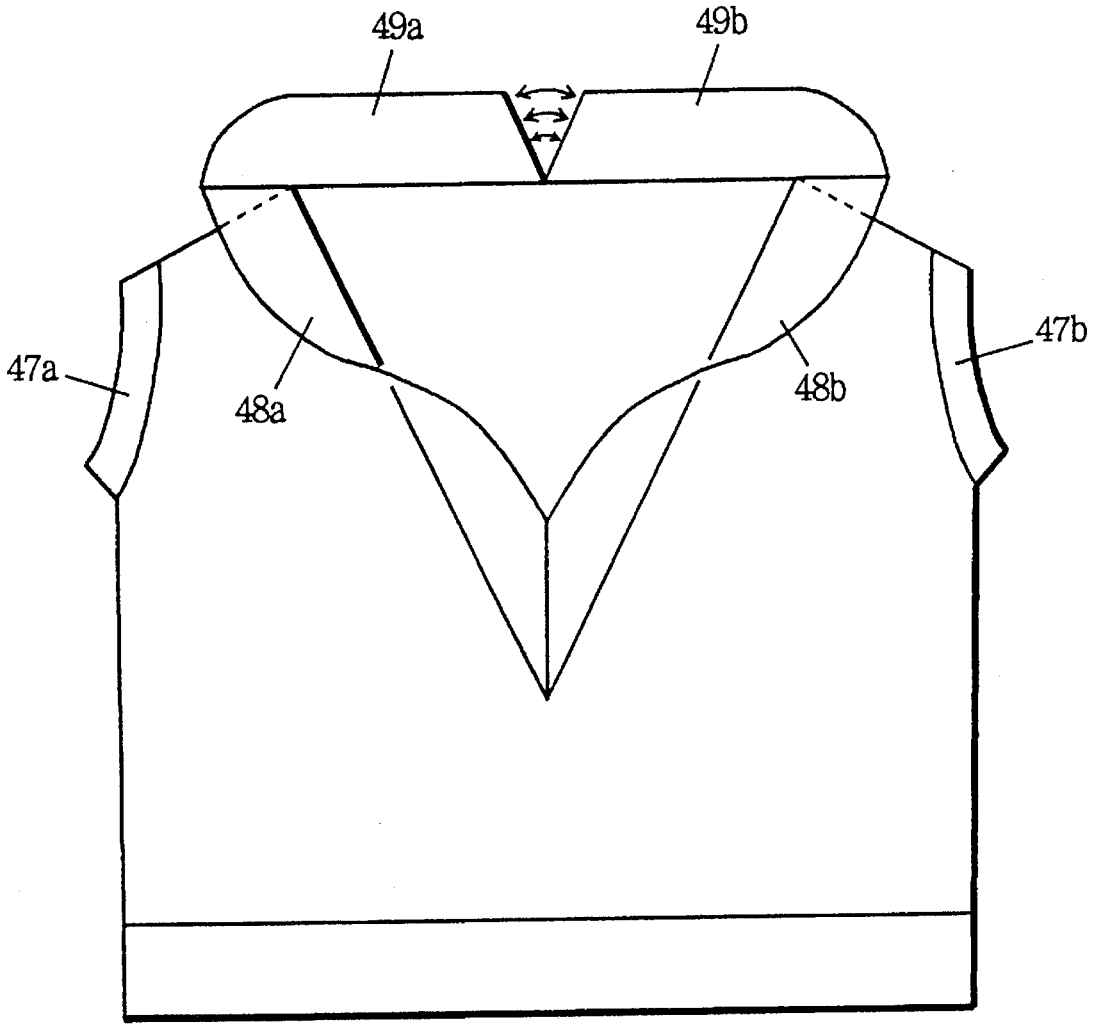
FIG. 18 is a plan view of the vest 41 knitted in the modification of Embodiment 2.
Figure 19:
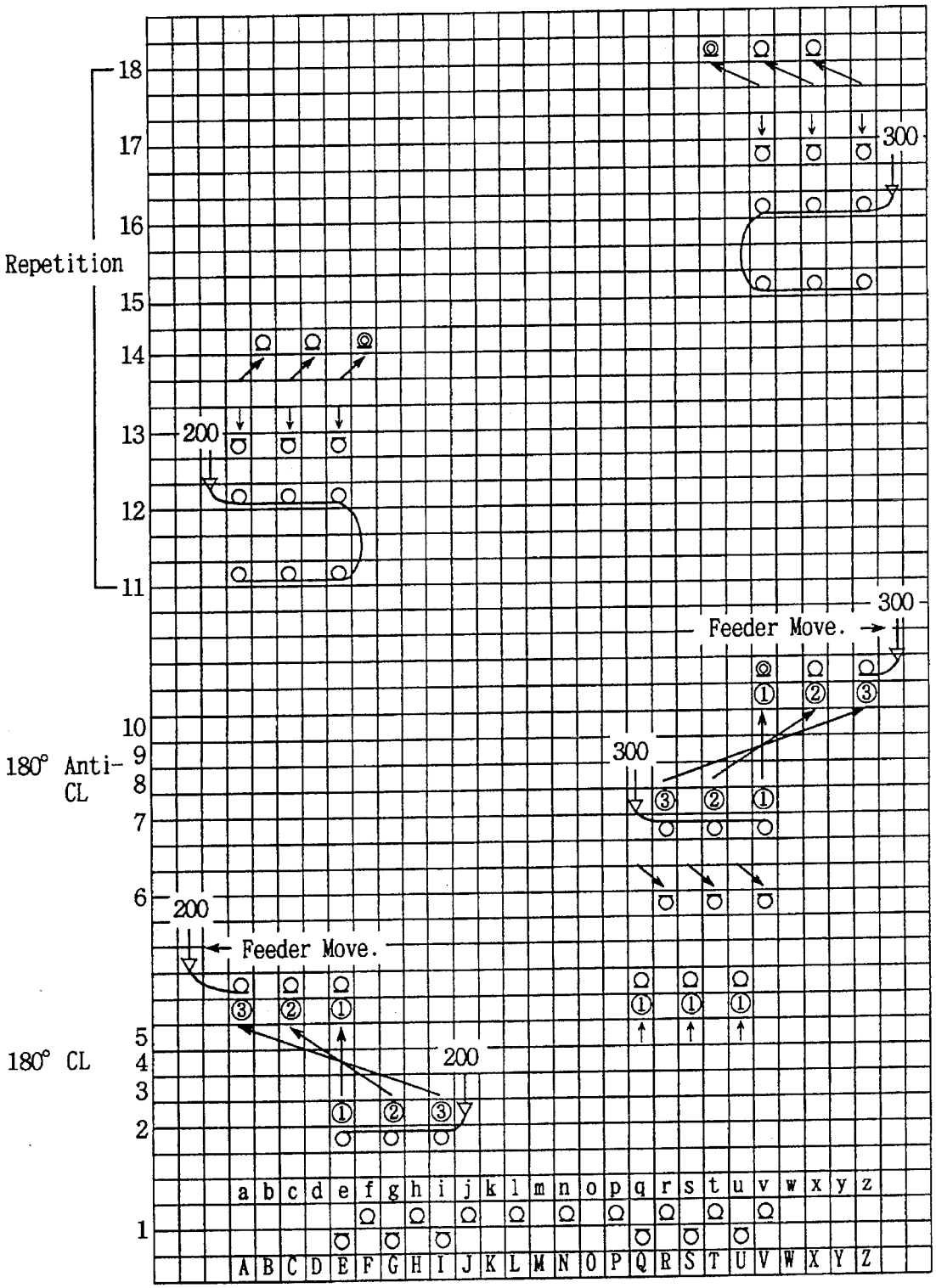
FIG. 19 is a diagram showing a part of the knitting course of said modification.

In Embodiment 2, in the course 11 and the course 12 and in the course 15 and the course 16, etc., every two courses of the back collar 49 is joined with the stitches of the collar knitting area. It, however, may be joined for every one course. In the above-mentioned embodiment, the back collar 49 is knitted from one end of the collar knitting area. However, as shown for example in FIG. 18 and FIG. 19, a back collar **49*a* may be knitted from the needle f to the needle V of the collar knitting area 50, and at the same time, a back collar 49*b* may be knitted from the needle v to the needle f. In this case, the back collar 49*a* and the back collar 49*b* are knitted till they abut each other, then the back collar 49*a* and the back collar 49*b* are joined together, the stitches of the outermost wales and the stitches of the innermost wales of their final courses being overlapped with each other, respectively. In this case, as shown in the course 11 through the course 18 of FIG. 19, alternate knitting of the back collar 49***a* and the back collar 49*b* may be repeated. In the above-mentioned embodiment, in the course 28 through the course 30, the back collar 49 is turned clockwise by 180 degrees to overlap it with the left collar 48*b*. In direct contrast to it, the left collar 48*b* may be turned clockwise by 180 degrees to transfer it to the front bed, and after that it may be overlapped with the back collar 49. In this case, the binding-off is made on the face side of the fabric at the time of completion of knitting.

EMBODIMENT 3

Figure 20:
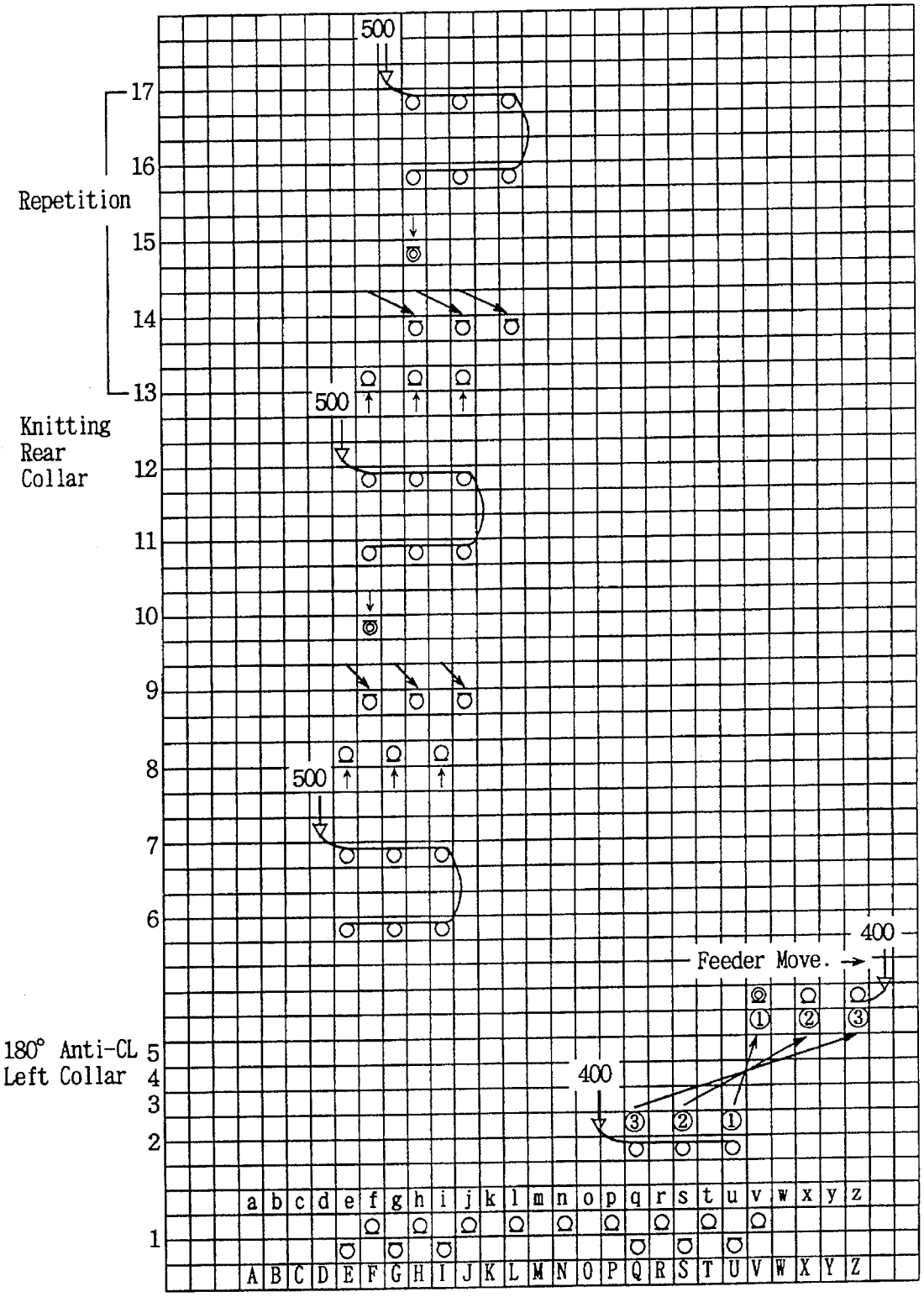
FIG. 20 and FIG. 21 are knitting course diagrams of Embodiment 3 according to the present invention.
Figure 21:
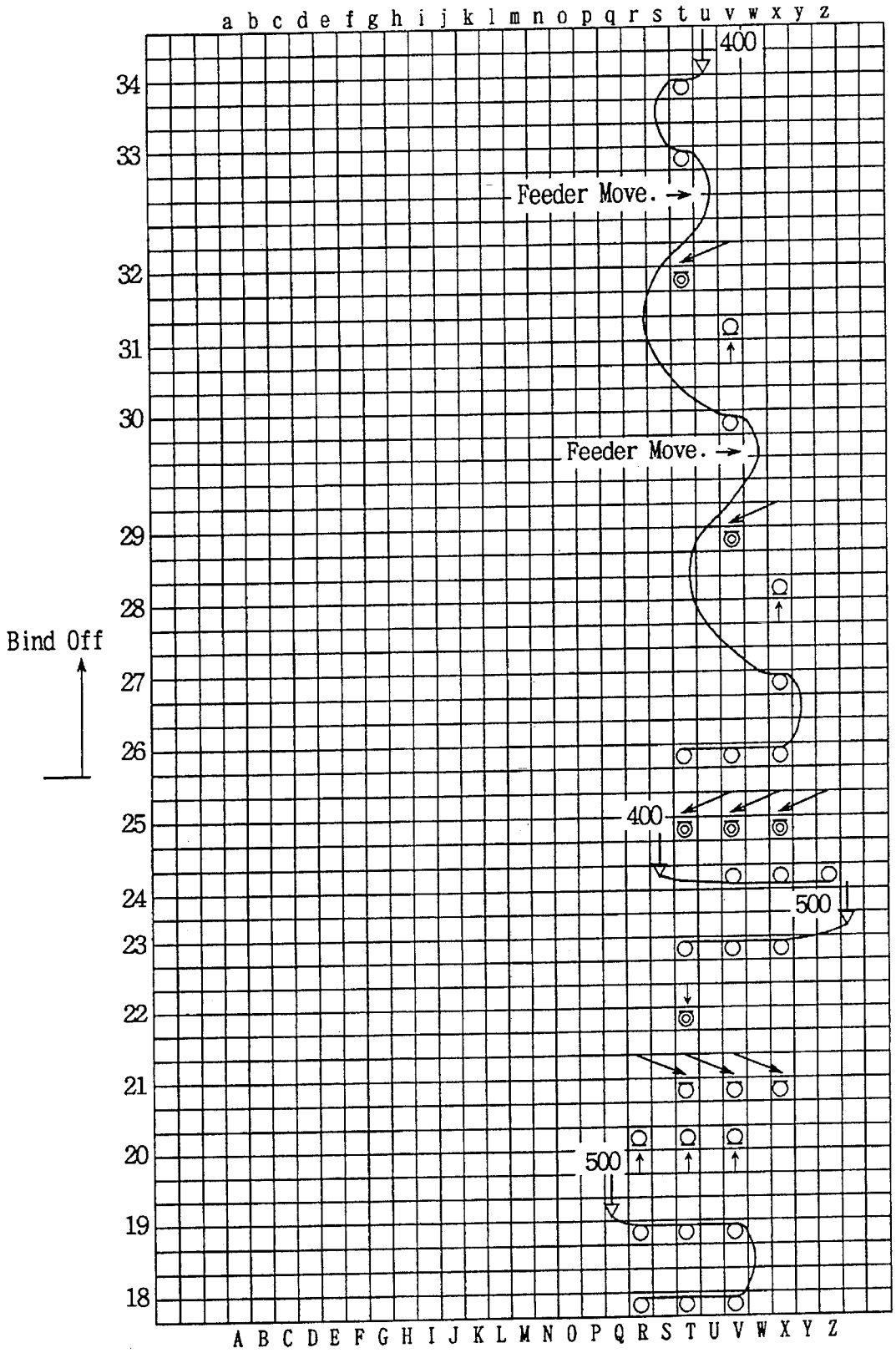
Figure 22:
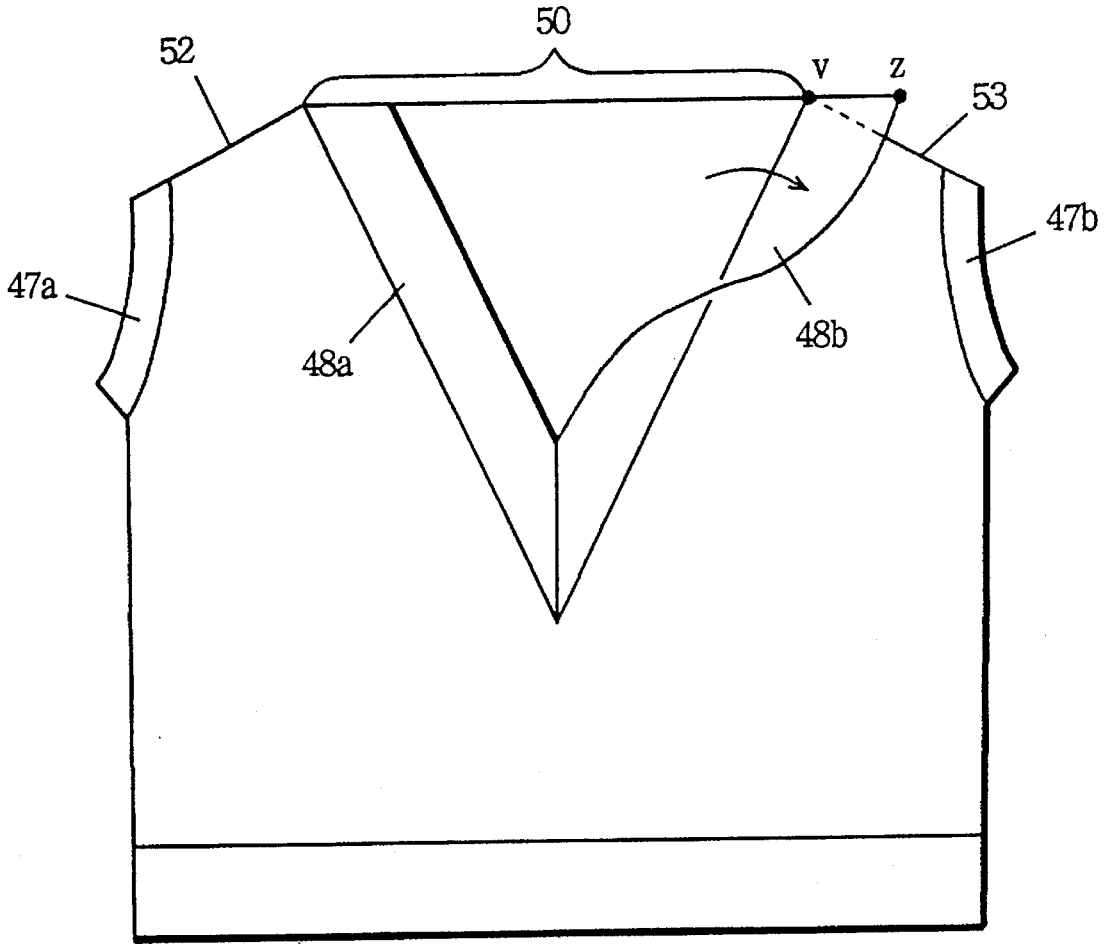
FIG. 22 is a plan view of the vest 41 at the time of completion of the course 5 of FIG. 20.

Embodiment 3 according to the present invention will be described with reference to FIG. 20 through FIG. 23. Embodiment 3 differs from Embodiment 2 in that the back collar is knitted on the front bed, and that the back collar 49 and the left collar 48*b* are joined together. As the vest of Embodiment 3 is knitted in the same shape of the vest of Embodiment 2, the same symbols will be used in the following description. First, the course 1 of FIG. 20 shows the vest 41 when the joint of the left and right shoulders 52, 53 is completed. Starting from this condition, in the course 2, yarn is fed by the yarn feeder 400, which has been used for knitting the left collar 48*b* on the left front body 42*b*, to the needles Q, S and U of the front bed on which the stitches of the left collar 48*b* are held to form stitches. Next. knitting shown in the course 3 through the course 5 is carried out. The left collar 48*b* is turned counterclockwise by 180 degrees to reverse the order of stitches sidewise and transfer the left collar 48*b* to the rear bed. To this end, the transfer is made in the order beginning with the stitch of the innermost wale of the left collar 48*b* held on the needle U and ending with the stitch of the outermost wale on the needle Q. First, in the course 3, the stitch of the innermost wale of the back body 43 held on the needle U is transferred to the needle v. At the time, the stitch of the side end of the collar knitting area 50 of the back body 43 is already held on the needle v. Thus the stitch of the innermost wale of the left collar 48*b* and the stitch of the collar knitting area 50 are overlapped with each other. Next, in the course 4, the stitch on the needle S of the front bed is transferred to the needle x of the rear bed. In the course 5, the stitch of the outermost wale of the left front body 42*b* held on the needle Q is transferred to the needle z. As mentioned above, the stitches of the left collar 48*b* are transferred to the outside of the collar knitting area 50 in the order starting with the stitch of the innermost wale held on the needle U and ending with the stitch of the outermost wale held on the needle Q. Hence the left collar 48*b* of the vest 41 is transferred, as shown in FIG. 22, to the rear bed with its order of stitches reversed sidewise. The stitch of the outermost wale of the left collar 48*b* is held on the needle z of the rear bed, and the stitch of the innermost wale is held on the needle v. The left collar 48*b* abuts the collar knitting area 50.

Next, the yarn feeder 400 is moved to a position at which it does not interfere with knitting, then in the course 6 and the course 7, yarn is fed by the yarn feeder 500 to the needles E, G and I, on which the stitches of the right collar 48*a* are held, to form stitches. Next, in the course 8, the stitches of the right collar 48*a* held on the needles E, G and I are transferred to the needles e, g and i of the rear bed. In the course 9, the front and rear beds are moved relatively, and the stitches of the right collar 48*a* are transferred to the needles F, H and J of the front bed. In the course 10, the stitch of the side end of the collar knitting area 50 is made to oppose the stitch of the right collar 48*a* held on the needle F, and after that, the stitch of the collar knitting area 50 held on the needle f is transferred to the needle F. With this, the stitch of the innermost wale of the right collar 48*a* and the stitch of the collar knitting area 50 are overlapped with each other on the needle F.

In the course 11 and the course 12, yarn is fed by the yarn feeder 500, which has been used for knitting the right collar 48*a*, to the needles F, H and J of the front bed on which the stitches of the back collar 49 are held, to form stitches. This joins the stitch of the collar knitting area 50 of the back body 43 and the stitch of the innermost wale of the right collar 48*a*. In succession to the right collar 48*a* formed on the right front body 42*a*, the back collar 49 is knitted on the collar knitting area 50 of the back body 43. Next, in the course 13, the newly formed stitches of the back collar 49 are transferred to the needles f, h and j of the rear bed. In the course 14, the front and rear beds are moved relative to each other, then the stitches are transferred to the needles H, J and L of the front bed. Next, in the course 15, the front and rear beds are moved relative to each other, then the stitch on the needle h of the rear bed is transferred to the needle H of the front bed. As a result, the stitch of the innermost wale of the back collar 49 and the stitch of the collar knitting area 50 are overlapped with each other. In the course 16 and the course 17, yarn is fed to the needles H, J and L, on which the stitches of the back collar 49 are held, to form stitches. After that, the knitting shown in the course 13 through the course 17 is repeated to reach the condition shown in the course 21 of FIG. 21.

Figure 23:
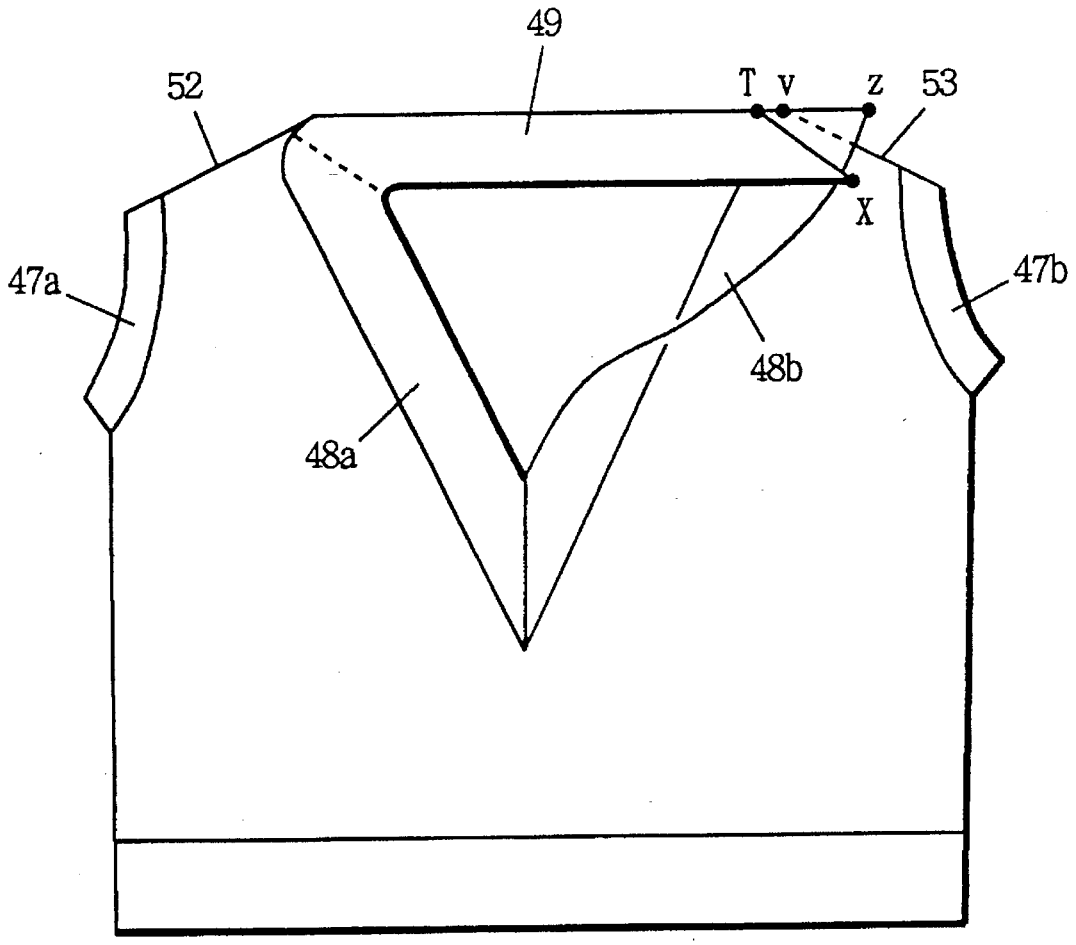
FIG. 23 is a plan view of the vest 41 at the time of completion of the course 24 of FIG. 21.

Next in the course 22, the stitch of the collar knitting area 50 is transferred to the needle T of the front bed. In the course 23, yarn is fed by the yarn feeder 500 to the needles T, V and X of the front bed to form stitches and knit the back collar 49. Next, in the course 24, yarn is fed by the yarn feeder 400 to the needles v, x and z of the rear bed, on which the stitches of the left collar 48*b* are held, to form stitches. When the left collar 48*b* is transferred to the rear bed in the course 3 through the course 5, the stitch of the innermost wale of the left collar 48*b* held on the needle U is overlapped with the stitch held on the needle v of the rear bed. Hence, in the course 24, when the yarn is fed to the needles v, x and z of the rear bed, the stitch of the collar knitting area 50 and the stitch of the innermost wale of the left collar 48*b* are joined together. Under this condition, as shown in FIG. 23, with regard to the back collar 49 held on the front bed, the stitch of the innermost wale is held on the needle X, and the stitch of the outermost wale is held on the needle T. With regard to the left collar 48*b* held on the rear bed, the stitch of the outermost wale is held on the needle z, and the stitch of the innermost wale is held on the needle v. Both the collars are opposing to each other, front and rear.

Next, in the course 25, the stitches of the left collar 48*b* held on the needles v, x and z are transferred to the needles T, V and X. As a result, in the final courses of the back collar 49 and the left collar 48*b*, the stitches of the outermost wales and the stitches of the innermost wales overlap with each other, respectively. In the course 26, yarn is fed by the yarn feeder 400 to the needles T, V and X of the front bed to form stitches. This joins the final courses of the left collar 48*b* and the back collar 49 together. In the course 27 through the course 34, similarly to Embodiment 2, binding-off is made and stitches are removed from the needles to complete the knitting of the vest 41.

As described above, in Embodiment 3, the vest 41 is knitted in the following manner. The front body 42 and the back body 43 are joined together at the left and right shoulders 52 and 53. After that, the left collar 48*b* is transferred with its order of stitches reversed sidewise to abut the outside of the collar knitting area 50. The stitch of the innermost wale of the right collar 48*a* and the stitch of the collar knitting area 50 are overlapped with each other, and the back collar 49 is knitted while the back collar 49 is moved towards the left collar 48*b*. After that, the final courses of the back collar 49 and the left collar 48*b* are joined together, with the stitches of the outermost wales and the stitches of the innermost wales overlapped with each other, respectively. The vest 41, when the knitting is completed, has a ring-shaped collar 51, as shown in FIG. 9, on the circumference of the neck hole 45. Said collar 51 is knitted continuously and its wale directions are continuous. As the back collar 49 formed on the back body 43 is knitted in continuation with the right collar 48*a*, both the collars are continuous. The back collar 49 and the left collar 48*b* are joined together, with the stitches of the outermost wales and the stitches of the innermost wales of their respective final courses overlapped with each other. Thus the wale directions of the back collar 49 and those of the left collar 48*b* are continuous to each other.

In Embodiment 3, for instance, in the course 10 of FIG. 20, the stitch of the collar knitting area 50 of the back body 43 is overlapped with the stitch of the innermost wale of the back collar 49 held on the needle F of the front bed. However, in direct contrast to it, the stitch of the innermost wale of the back collar 49 may be overlapped with the stitch of the collar knitting area 50 held on the needle f of the rear bed, and in the course 11 and the course 12, yarn may be fed to the needle f of the rear bed and the needles H and J of the front bed.

The applications of the respective embodiments described above are not limited to the vests shown in FIG. 1 and FIG. 9. They are applicable, for example, to knitting of sweaters and cardigans. In case of a cardigan, starting from the bottom rib, yarn is fed to knit the right front body, the back body and the left front body in this order in a reciprocating manner; a continuous collar is formed on the front pieces formed on plural wales at the edges of the respective fabrics of the front body. Thus the neck hole in the present invention is not limited to the neck hole 45 of the vest 41 of FIG. 9. The neck hole may be open in one end just like that of cardigan.

In the above-mentioned Embodiment 2 and Embodiment 3, description was given by taking an example in which the collar 51 is knitted by using the same yarn feeder with the front body 42. However, the collar 51, for example, may be knitted with a yarn different from that of the front body 42. The collar 51 may have the rib stitch or the purl stitch rather than the plain stitch. It should be noted that the respective embodiments are just examples to facilitate the understanding of the knitting method according to the present invention. The present invention is not limited, in any sense, to the embodiments.

I claim:

1. A knitting method using a flat knitting machine having at least one pair of needle beds extending sidewise and abutting each other, wherein each of said one pair of needle beds has a large number of needles thereupon, said one pair of needle beds form a trick gap between them, at least one of said pair of needle beds can be racked sidewise, and wherein a fabric can be transferred between said needle beds, said method comprising the steps of:

holding a first fabric on one needle bed of said pair of needle beds, wherein the first fabric has a large number of stitches, with a back of the first fabric facing the trick gap and a face of the first fabric on an opposite side thereof;

holding a second fabric on another needle bed of said one pair of needle beds, wherein the second fabric has a large number of stitches, with a back of the second fabric facing the trick gap and a face of the second fabric on an opposite side thereof; and binding off said first fabric and said second fabric; said knitting method further comprising a) a process of transferring one of said first fabric and said second fabric to the needle bed opposite from the needle bed on which the fabric to be transferred is currently held;

b) a process of transferring, after the process a), the another of the first fabric and second fabric to the needle bed opposite from the needle bed on which the fabric to be transferred is currently held; and c) a process of transferring, after the processes a) and b), one of said first fabric and second fabric to the needle bed opposite to the needle bed on which the fabric to be transferred is currently held, and overlapping stitches of said first fabric and second fabric on the needles of the needle bed to which the transfer was made.

2. A knitting method as recited in claim 1, wherein in the process a), said fabric is transferred to the opposing needle bed with an order of stitches of the fabric reversed sidewise, and wherein, in the process c), said fabric is transferred to the opposing needle bed with an order of stitches of the fabric reversed sidewise.

3. A knitting method as recited in claim 2, wherein the first fabric and second fabric have at least one end, respectively, and the stitches proceed from said ends towards an inner side, and the sidewise reversals of the order of stitches in the processes a) and c) comprise the steps of transferring one stitch near the end to the opposing needle bed, racking the needle bed on which the fabric is currently held, beyond the one stitch transferred, to a fabric side of end thereupon, and then transferring a next stitch on the inner side to the opposing needle bed, then racking the needle bed on which the fabric is currently held, beyond the stitches transferred, to the side of the end thereupon, and then repeating the step of transferring another next inner stitch to the opposing needle bed.

4. A knitting method using a flat knitting machine having at least one pair of front and rear needle beds extending sidewise and abutting each other, wherein each of said one pair of needle beds has a large number of needles, said one pair of needle beds form a trick gap between them, at least one of said pair of needle beds can be racked sidewise, and a fabric can be transferred between said needle beds, knitting a front body (42) on one of said needle beds, and knitting a back body (43) on the other needle bed, wherein the front body and the back body are opposed to each other, and joining the front body and the back body at shoulders (52, 53) and knit a collar (51) on the circumference of a neck hole (45), being characterized in that said knitting method further includes dividing the front body (42) above the lower end of the neck hole (45) into a right front body (42*a*) and a left front body (42*b*) and knitting them, and knitting a first collar (48*a*) and a second collar (48*b*) along circumference portions of said hole of said right and left front bodies, wherein the collars consist of plurality of wales and have wale directions along said circumference and a course direction perpendicular to that of the direction of said wales; and knitting a back collar (49, 49*a*, 49*b*) on a collar knitting area (50) along the circumference of said hole of the back body;

wherein the front body and the back body are knitted from a bottom thereof toward a top thereof, and the knitted front body and back body are taken out beneath the needle beds, said back collar is in conjunction with said collar knitting area, and said back collar has a wale direction along the circumference of said hole and a course direction perpendicular to said wale direction, and the wale direction of said back collar is continuous to the wale directions of said first and second collars (48*a*, 48*b*).

5. A knitting method of claim 4 being characterized in that said knitting process further includes transferring at least one of the first and second collars, with the orders of stitches reversed sidewise, from the needle bed on which said collar is currently held to the opposing needle bed.

6. A knitting method of claim 5 being characterized in that in said transferring process further includes reversing the order of stitches is given to both the first and second collars.

7. A knitting method of claim 4 being characterized in that said knitting process further includes overlapping the stitch of the innermost wale of at least one of the first and second collars with the stitch of the side end of the collar knitting area and, after that, repeating a cycle comprising knitting the specified number of courses of said collar and after that overlapping the stitch of the innermost wale of said collar with one stitch of the collar knitting area, wherein the hole side of said collar is defined as the outer side, and the opposite side as the inner side, and the above-mentioned collar knitting area has two side ends.

8. A knitting method of claim 4 being characterized in that said knitting process further includes transferring the first and second collars (48*a*, 48*b*) to the opposite needle bed, and to the outside of the collar knitting area (50), with an ordering of stitches of the respective collars (48*a*, 48*b*) reversed, and knitting said back collar (49), in succession with at least one of said first and second collars, said back collar being joined with said collar knitting area (50) of the back body (43).

9. A knitting method of claim 4 being characterized in that said knitting process further includes transferring the first and second collars (48*a*, 48*b*) to the opposite needle bed, and to the outside of the collar knitting area (50), with an ordering of stitches of the respective collars (48*a*, 48*b*) reversed, and knitting a first back collar (49*a*), in succession with said first collar, said first back collar (49*a*) being joined with said collar knitting area (50), and knitting a second back collar (49*b*), in succession with said second collar, said second back collar (49*b*) being joined with said collar knitting area (50).

10. A knitting method of claim 4 being characterized in that said knitting process further includes transferring the second collar (48*b*) to the opposite needle bed, and to the outside of the collar knitting area (50), with an ordering of stitches reversed, and knitting the back collar (49), in succession with said first collar, said back collar (49) being joined with said collar knitting area (50).

11. A knitting method of claim 4 being characterized that said knitting process further includes transferring the first and second collars (48*a*, 48*b*) to the opposite needle bed, and to the outside of the collar knitting area (50), with an ordering of stitches of the respective collars (48*a*, 48*b*) reversed, overlapping the stitch of an innermost wale of said first collar with the stitch of the side end of the collar knitting area, knitting the back collar (49), in succession with said first collar, said back collar (49) being joined with said collar knitting area (50), and repeating, in knitting the back collar (49), a cycle of knitting one new course of the back collar, moving the newly knitted stitches to the second collar (48*b*) side by racking the needle beds, so that the stitch of the innermost wale of the back collar (49) is overlapped with one stitch of the collar knitting area (50), untill the back collar (49) abuts the second collar (48*b*), wherein said hole side of said collar is defined as the outer side, and the opposite side as the inner side, and said collar knitting area has two side ends.

12. A knitting method of claim 4 being characterized in that said process b includes transferring the first and second collars (48*a*, 48*b*) to the opposite needle bed, and to the outside of the collar knitting area (50), with an ordering of stitches of the respective collars (48*a*, 48*b*) reversed, overlapping stitches of an innermost wales of said first and second collars (48*a*, 48*b*) with stitches of side ends of the collar knitting area (50), feeding yarn to the needles on which the stitches of the first collar (48*a*) are held to knit, in succession with the first collar (48*a*), the first back collar (49*a*), said first collar (48*a*) being joined with the collar knitting area (50), feeding yarn to the needles on which the stitches of the second collar (48*b*) are held to the knit, in succession with the second collar (48*b*), a second back collar (49*b*), said second collar (48*b*) being joined with the collar knitting area (50), and repeating a cycle of knitting one course of a first back collar (49*a*) and one course of the second back collar (49*b*), moving the newly knitted stitches of the first and second back collars (49*a*, 49*b*) so that they come closer to each other by racking the needle beds, and so that the stitches of innermost wales of the first and second back collars are overlapped with stitches of the collar knitting area (50), untill the first and second back collars (49*a*, 49*b*) abut each other.

13. A knitting method of claim 4 being characterized in that said knitting process further includes transferring the second collar (48*b*) to the opposite needle bed, and to the outside of the collar knitting area (50), with the order of stitches reversed, overlapping a stitch of an innermost wale of said first collar with a stitch of the side end of the collar knitting area, wherein said collar knitting area has two side ends, knitting the back collar (49), in succession with said first collar, said back collar (49) being joined with said collar knitting area (50), and repeating, in knitting the back collar (49) where in said hole side of said collar is defined as the outer side, and the opposite side as the inner side, a cycle of knitting one new course of the back collar, moving the newly knitted stitches to the second collar (48*b*) side by racking the needle beds, so that the stitch of an innermost wale of the back collar (49) is overlapped with one stitch of the collar knitting area (50), untill the back collar (49) abuts the second collar (48*b*).

14. A knitting method of claim 6 being characterized in that the back collar is knitted so that said back collar (49), first collar (48*a*) and second collar (48*b*) have a common order of wales, and the knitted back collar is bound off.

15. A knitted garment, comprising:

a front fabric panel;

a back fabric panel fastened to said front fabric panel, wherein said front fabric panel and said back fabric panel are attached by a flat knitting machine having at least one pair of needle beds extending sidewise and abutting each other, wherein each of said one pair of needle beds has a large number of needles thereupon, and wherein said one pair of needle beds form a trick gap therebetween, and wherein at least one of said pair of needle beds can be racked sidewise, and wherein one of the front fabric panel and the back fabric panel can be transferred between the needle beds, and wherein the garment is knitted by a method comprising the steps of holding the first fabric panel on one needle bed of the pair of needle beds, wherein the front fabric panel has a large number of stitches, with a back of the front fabric panel facing the trick gap and a face of the front fabric panel on an opposite side thereof;

holding the back fabric panel on another needle bed of the one pair of needle beds, wherein the back fabric panel has a large number of stitches, with a back of the back fabric panel facing the trick gap and a face of the back fabric panel on an opposite side thereof; and binding off the front fabric panel and the second fabric panel, wherein said garment is further knitted by a method comprising a) a process of transferring one of the front fabric panel and the back fabric panel to the needle bed opposite from the needle bed on which the fabric to be transferred is currently held, b) a process of transferring, after the process a) of another of the front fabric panel and the back fabric panel to the needle bed opposite from the needle bed on which the fabric to be transferred is currently held, c) a process of transferring, after processes a) and b), one of the front fabric panel and the back fabric panel to the needle bed opposite to the needle bed on which the fabric to be transferred is currently held, and overlapping stitches of the front fabric panel and the back fabric panel on the needles of the needle bed to which the transfer was made.

16. A knitted garment comprising:

a front fabric panel;

a back fabric panel attached to said front fabric panel, said front and back fabric panels being attached using a flat knitting machine having at least one pair of front and rear needle beds extending sidewise and abutting each other, wherein each of said one pair of needle beds has a large number of needles, said one pair of needle beds form a trick gap between them, at least one of said pair of needle beds can be racked sidewise, and a fabric can be transferred between said needle beds, said front fabric panel and said back fabric panel being formed by knitting the front fabric panel on one of said needle beds, and knitting a back fabric panel on the other needle bed, wherein the front fabric panel and the back fabric panel are opposed to each other, and joining the front fabric panel and the back fabric panel at shoulders and knitting a collar on the circumference of a neck hole, being characterized in that said knitted garment is further formed by a) a process of dividing the front fabric panel above the lower end of the neck hole into a right front fabric panel and a left front fabric panel and knitting them, and knitting the first collar and the second collar along the circumference portions of said hole of said right and left front fabric panels, wherein said collars consist of plurality of wales and have wale directions along said circumference and a course direction perpendicular to that of the direction of said wales; and b) a process of knitting a back collar on the collar knitting area along the circumference of said hole of the back fabric panel;

wherein the front fabric panel and the back fabric panel are knitted from a bottom thereof toward a top thereof, and the knitted front fabric panel and back fabric panel are taken out beneath the needle beds, said back collar is in conjunction with said collar knitting area, and said back collar has a wale direction along the circumference of said hole and a course direction perpendicular to said wale direction, and the wale direction of said back collar is continuous to the wale directions of said first and second collars.

* * * * *